US008182077B2

(12) United States Patent
Kanbe et al.

(10) Patent No.: US 8,182,077 B2
(45) Date of Patent: May 22, 2012

(54) INK CARTRIDGE ASSEMBLIES HAVING ADAPTER FOR EASILY REMOVING INK CARTRIDGE FROM A MOUNTING PORTION

(75) Inventors: Tomohiro Kanbe, Nagoya (JP); Hirotake Nakamura, Nagoya (JP); Shingo Hattori, Nagoya (JP); Akio Yoshinari, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 402 days.

(21) Appl. No.: 12/402,236

(22) Filed: Mar. 11, 2009

(65) Prior Publication Data

US 2009/0322835 A1 Dec. 31, 2009

(30) Foreign Application Priority Data

Jun. 30, 2008 (JP) ..... 2008-171844
Jun. 30, 2008 (JP) ..... 2008-171887

(51) Int. Cl.
*B41J 2/175* (2006.01)
*B41J 2/17* (2006.01)
*B41J 29/38* (2006.01)

(52) U.S. Cl. ..... 347/86; 347/7; 347/84

(58) Field of Classification Search ..... 347/86
See application file for complete search history.

(56) References Cited

U.S. PATENT DOCUMENTS 5,138,344 A * 8/1992 Ujita ..... 347/86
5,506,611 A 4/1996 Ujita et al.
5,860,363 A * 1/1999 Childers et al. ..... 347/86
5,953,031 A * 9/1999 Omata et al. ..... 347/86
6,062,667 A 5/2000 Matsui et al.
6,076,920 A 6/2000 Zapata et al.
6,312,084 B1 11/2001 Ujita et al.
6,764,169 B2 * 7/2004 Hall et al. ..... 347/85
6,786,583 B2 9/2004 Ota et al.
6,880,313 B1 4/2005 Gessford et al.
7,316,471 B2 1/2008 Hattori et al.
7,360,858 B2 4/2008 Hayamizu et al.
2001/0033315 A1 * 10/2001 Hatasa et al. ..... 347/86
2001/0045977 A1 * 11/2001 King et al. ..... 347/86
2003/0081087 A1 5/2003 Sakai et al.
2003/0085967 A1 5/2003 Ota et al.

(Continued)

FOREIGN PATENT DOCUMENTS

CN 2683375 Y 3/2005

(Continued)

OTHER PUBLICATIONS

European Patent Office, European Search Report for Related EP Application No. 08013451 dated Jan. 15, 2009.

(Continued)

*Primary Examiner* — Shelby Fidler
(74) *Attorney, Agent, or Firm* — Baker Botts L.L.P.

(57) ABSTRACT

An ink cartridge includes an ink tank defining an ink chamber therein, in which the ink chamber is configured to store ink therein, and an adapter configured to be coupled to the ink tank. The adapter and the ink tank are separate members, and the adapter includes a main body, and an operation portion extending from the main body in a particular direction. When the adapter is coupled to the ink tank, the operation portion extends toward the ink tank and extends further in the particular direction than the ink tank.

17 Claims, 18 Drawing Sheets

U.S. PATENT DOCUMENTS

| | | | | |
|---|---|---|---|---|
| 2004/0027432 | A1 * | 2/2004 | Childers et al. | 347/86 |
| 2004/0104984 | A1 | 6/2004 | Hall et al. | |
| 2004/0176735 | A1 | 9/2004 | Snell | |
| 2005/0168540 | A1 | 8/2005 | Wilson et al. | |
| 2005/0212877 | A1 * | 9/2005 | Liang | 347/86 |
| 2005/0275700 | A1 * | 12/2005 | Buchanan et al. | 347/86 |
| 2006/0023040 | A1 | 2/2006 | Castle et al. | |
| 2007/0070141 | A1 | 3/2007 | Hattori et al. | |
| 2007/0229615 | A1 | 10/2007 | Hattori et al. | |
| 2007/0279464 | A1 * | 12/2007 | Harazim | 347/86 |
| 2008/0198210 | A1 * | 8/2008 | Umeda | 347/86 |
| 2008/0239038 | A1 * | 10/2008 | Yoshimoto et al. | 347/86 |
| 2009/0207215 | A1 * | 8/2009 | Fost | 347/85 |
| 2010/0103231 | A1 | 4/2010 | Iwamura et al. | |
| 2010/0289847 | A1 * | 11/2010 | Ishizawa et al. | 347/86 |

FOREIGN PATENT DOCUMENTS

| | | | |
|---|---|---|---|
| CN | 101195302 | A | 6/2008 |
| EP | 1839871 | A | 10/2007 |
| EP | 1839873 | A | 10/2007 |
| EP | 1905596 | A1 * | 4/2008 |
| EP | 2045079 | A1 | 4/2009 |
| JP | H03-213349 | A | 9/1991 |
| JP | 2005-028614 | A | 2/2005 |
| JP | 2007-144811 | A | 6/2007 |
| WO | 9745269 | A1 | 12/1997 |
| WO | 0119615 | A1 | 3/2001 |

OTHER PUBLICATIONS

European Patent Office, extended European Search Report for European Patent Application No. 11160606.7, dated May 23, 2011.

European Patent Office, extended European Search Report for European Patent Application No. 11160584.6, dated May 23, 2011.

The State Intellectual Property Office of the People'S Republic of China, Notification of the Second Office Action for Chinese Patent Application No. 200810211194.4, issued Apr. 20, 2011.

The State Intellectual Property Office of the People's Republic of China, Notification of First Office Action for Chinese Patent Application No. 200810211192.5, issued Sep. 13, 2010.

European Patent Office, European Search Report for European Patent Application No. 08013450, dated Jan. 12, 2009.

European Patent Office, Office Action for European Patent Application No. 08013451.3, dated May 19, 2011.

European Patent Office, Observations by Third Party concerning European Patent Application No. 08013451.3, dated Apr. 12, 2011.

* cited by examiner

INK CARTRIDGE ASSEMBLIES HAVING ADAPTER FOR EASILY REMOVING INK CARTRIDGE FROM A MOUNTING PORTION

CROSS-REFERENCE TO RELATED APPLICATION

The present application claims priority from Japanese Patent Application No. JP-2008-171887, which was filed on Jun. 30, 2008, and Japanese Patent Application No. JP-2008-171844, which was filed on Jun. 30, 2008, the disclosures of which are incorporated herein by reference in their entirety.

BACKGROUND OF THE INVENTION

1. Field of the Invention

The present invention relates generally to ink cartridges. In particular, the present invention is directed towards ink cartridges which comprise an adapter.

2. Description of Related Art

A known inkjet recording apparatus, such as the inkjet recording apparatus described in JP-A-2007-144811, is configured to record an image on a sheet of paper using ink. This known inkjet recording apparatus has a recording head, and the recording head has a plurality of nozzles formed therein. The recording head is configured to selectively eject ink from the nozzles to form an image on a sheet of paper. The known inkjet recording apparatus also has a cartridge mounting portion to which a known ink cartridge is removably mounted. The known ink cartridge has an ink chamber configured to store ink therein, and when the ink cartridge is mounted to the mounting portion, ink is supplied from the ink chamber to the recording head.

Another known recording apparatus, such as the recording apparatus described in JP-A-2007-144811 comprises a mounting portion and a lever pivotably provided at the mounting portion. Another known ink cartridge is configured to be mounted to the mounting portion. The lever has claws, and the ink cartridge has engage portions. After the ink cartridge is mounted to the mounting portion, when the lever pivots, the claws engage and pull the engage portions, such that the ink cartridge is pulled toward an exterior of the mounting portion. Consequently, the ink cartridge is partially positioned outside the mounting portion, and a user grasps the portion of the ink cartridge, which portion is positioned outside the mounting portion, and remove the ink cartridge from the mounting portion.

Nevertheless, the claws and the engage portions need to be accurately positioned to engage each other. If the claws and the engage portions fail to be accurately positioned, the claws may not engage portions when the lever pivots. In such a case, the ink cartridge may not be pulled to the exterior of the mounting portion. Moreover, if the claws are accidentally broken, the ink cartridge also may not be pulled to the exterior of the mounting portion. In addition, the portion of the ink cartridge which is pulled out of the mounting portion by the claws may be a small portion, and it may be difficult for a user with a big hand to grasp the small portion of the ink cartridge to remove the ink cartridge from the mounting portion.

SUMMARY OF THE INVENTION

Therefore, a need has arisen for ink cartridges, which overcomes these and other shortcomings of the related art. A technical advantage of the present invention is that an ink cartridge is readily removed from a mounting portion with an aid of an adapter.

According to an embodiment of the present invention, an ink cartridge comprises an ink tank defining an ink chamber therein, in which the ink chamber is configured to store ink therein, and an adapter configured to be coupled to the ink tank. The adapter and the ink tank are separate members, and the adapter comprises a main body, and an operation portion extending from the main body in a particular direction. When the adapter is coupled to the ink tank, the operation portion extends toward the ink tank and extends further in the particular direction than the ink tank.

Other objects, features, and advantages of embodiments of the present invention will be apparent to persons of ordinary skill in the art from the following description of embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-18, like numerals being used for like corresponding portions in the various drawings.

Figure 1:
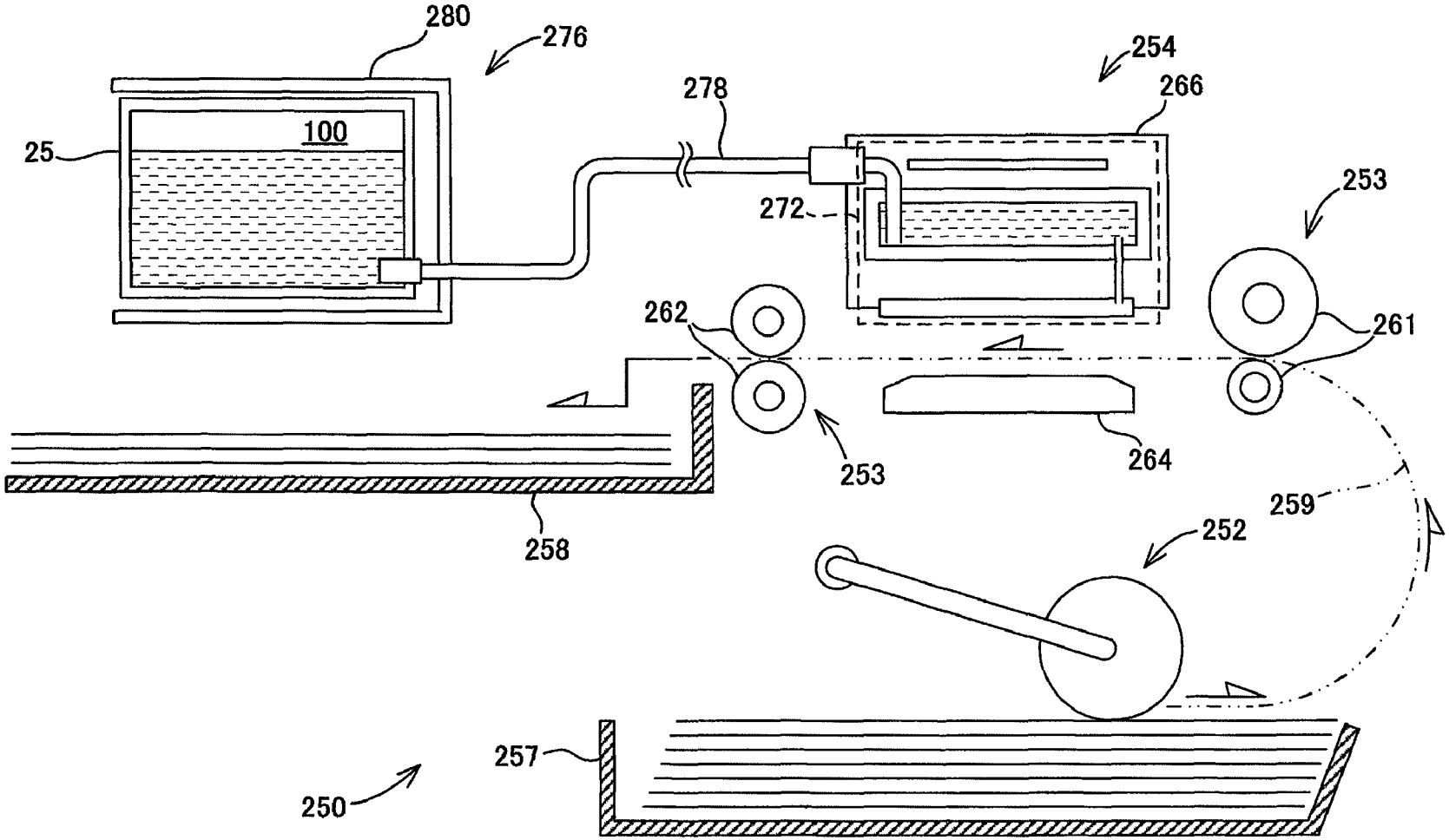
FIG. 1 is a cross-sectional, pattern diagram of a recording apparatus, according to an embodiment of the invention.

Referring to FIG. 1, an inkjet recording apparatus 250 according to an embodiment of the invention is depicted. Recording apparatus 250 may be configured to record an image, e.g., a monochrome image or a color image, on a recording medium, e.g., a sheet of paper, using at least one ink, e.g., four inks, such as a black ink, a yellow ink, a cyan ink, and a magenta ink. Recording apparatus 250 may comprise a feeding device 252, a transferring device 253, a recording device 254, and a cartridge mounting portion 276. Cartridge mounting portion 276 may be configured to receive an ink cartridge 25. Recording apparatus 250 also may comprise a first tray 257 and a second tray 258, and recording apparatus 250 may have a transfer path 259 extending from first tray 257 to second tray 258. Feeding device 252 may be configured to feed sheets of paper accommodated in first tray 257, one by one, to transfer path 259.

Transferring device 253 may comprise a first pair of transfer rollers 261 and a second pair of transfer rollers 262 positioned along transfer path 259. First pair of transfer rollers 261 may be positioned on the upstream side of recording device 254 and second pair of transfer rollers 262 may be positioned on the downstream side of recording device 254 along transfer path 259.

Recording apparatus 250 also may comprise a platen 264 positioned directly below recording device 254. The sheet of paper fed by feeding device 252 may be transferred onto platen 264 by first pair of transfer rollers 261. Recording device 254 may be configured to record an image on the sheet of paper being transferred over platen 264. The sheet of paper having passed over platen 264 may be transferred by second pair of transfer rollers 262 to second tray 258, which may be positioned at the downstream end of transfer path 259.

Recording device 254 may comprise a carriage 266, and a recording head 272 mounted in carriage 266. Carriage 266 may be supported by rails (not shown), such that carriage 266 slides on the rails in a direction perpendicular to the paper plane of FIG. 1. Recoding head 272 may be configured to eject ink onto the sheet of paper.

Cartridge mounting portion 276 may be configured to receive at least one ink cartridge 25, e.g., four ink cartridges 25 each storing a different color of ink, such as a black ink, a yellow ink, a cyan ink, and a magenta ink, respectively. Cartridge mounting portion 276 also may be configured to receive at least one adapter 27, e.g., four adapters 27 corresponding to four ink cartridges 25, respectively. Cartridge mounting portion 276 may comprise at least one case 280, e.g., four cases 280 and four adapters 27 corresponding to four ink cartridges 25, respectively. Ink cartridge 25 and adapter 27 may be configured to be inserted into and removed from case 280. Ink cartridge 25 may comprise an ink chamber 100 defined therein, and ink chamber 100 is configured to store ink therein. Recording apparatus 250 may comprise at least one flexible tube 278, e.g., four flexible tubes 278 connected to cases 280, respectively, and to recording head 272. When ink cartridge 25 and adapter 27 are mounted to cartridge mounting portion 276, ink may be supplied from ink chamber 100 to recording head 272 via a corresponding one of tubes 278.

Referring to FIGS. 2(A)-3(B), ink cartridge 25 may have a substantially rectangular, parallelepiped shape. A width of ink cartridge 25 in a width direction, as indicated by an arrow 31 may be relatively short, and each of a height of ink cartridge 25 in a height direction, as indicated by an arrow 32 and a depth of ink cartridge 25 in a depth direction, as indicated by an arrow 33, may be greater than the width of ink cartridge 25. Ink cartridge 25 may comprise a top outer face 43 and a bottom outer face 44 opposite top outer face 43. When ink cartridge 25 is mounted to cartridge mounting portion 276, top outer face 43 may be positioned above bottom outer face 44. Ink cartridge 25 may be configured to be inserted into case 280 in an insertion direction 30, which is parallel to depth direction 33. Ink cartridge 25 also may comprise a front outer face 41, a rear outer face 42 opposite front outer face 41, a left side outer face 45, and a right side outer face 46 opposite left side outer face 45. Each of front outer face 41 and rear outer face 42 is connected to top outer face 43 and bottom outer face 44, and each of left side outer face 45 and right side outer face 46 may be connected to front outer face 41, rear outer face 42, top outer face 43, and bottom outer face 44. Front outer face 41, rear outer face 42, top outer face 43, bottom outer face 44, left side outer face 45, and right side outer face 46 may be substantially parallel to its opposing face, and may be substantially perpendicular to its other faces. Each of an area of left side outer face 45 and an area of right side outer face 46 may be greater than each of an area of front outer face 41, an area of rear outer face 42, an area of top outer face 43, and an area of bottom outer face 44. Ink cartridge 25 may be inserted into case 280 from a front outer face 41 side.

Ink cartridge 25 also may comprise a frame 50, a movable member, e.g., a pivotable member 70, an air communication portion 80, an ink supply portion 90, a pair of side walls 60, a detection portion 140, and a protrusion 145. Frame 50 may define front outer face 41, rear outer face 42, top outer face 43, and bottom outer face 44 of ink cartridge 25. Pair of side walls 60 may be connected to, e.g., attached to, frame 50, and pair of side walls 60 may define left side outer face 45 and right side outer face 46 of ink cartridge 25, respectively.

Frame 50 may comprise a translucent resin material, e.g., a transparent material or a semi-transparent material, and light, e.g., visible or infrared light, may pass therethrough. In an embodiment, frame 50 may be manufactured by injection-molding polypropylene. Alternatively, frame 50 may be manufactured by injection-molding polyacetal, nylon, polyethylene, or the like. Frame 50 may comprise detection portion 140 positioned at front outer face 41, and detection portion 140 may comprise the same material as frame 50. Alternatively, substantially an entirety of frame 50 may comprise an opaque resin material, and detection portion 140 may comprise a translucent resin material, e.g., a transparent material or a semi-transparent material, and light, e.g., visible or infrared light, may pass therethrough.

Frame 50 may have a substantially square or rectangular perimeter extending along front outer face 41, top outer face 43, rear outer face 42, and bottom outer surface 44 defining a space in the interior thereof. Openings surrounded by frame 50 may be formed on both ends of frame 50 in width direction 31, respectively. Pair of side walls 60 may be connected to, e.g., adhered to, the ends of frame 50 in width direction 31, respectively, via an adhesion method, e.g., a thermal adhesion method, such that the openings are covered by pair of side walls 60, respectively, and a space surrounded by frame 50 and pair of side walls 60 defines ink chamber 100 therein. Pair of side walls 60 may comprise the same material as frame 50. Pair of side walls 60 may be a pair of translucent, flexible films, e.g., transparent or semi-transparent flexible films. Ink cartridge 25 may comprise a pair of covers covering pair of side walls 60 from the exterior of pair of side walls 60 to reinforce the rigidity of ink cartridge 25.

An amount of ink stored in ink chamber 100 may be optically or visually detected via detection portion 140. Detection portion 140 may extend outward from a middle portion of front outer face 41 of frame 50 in height direction 32, and may extend away from ink chamber 100. Detection portion 140 may comprise five rectangular walls, and may have a substantially a hollow, box shape. For example, detection portion 140 may comprise a front wall 140A, a pair of side walls 140B, a top wall 140C, and a bottom wall 140D. Front wall 140A may extend parallel to front outer face 41 and may be separated from front outer face 41 by a predetermined distance. Side walls 140B may be connected to front outer face 41 and front wall 140A, top wall 140C may be connected to top ends of front wall 140A and side walls 140B, and bottom wall 140D may be connected to bottom ends of front wall 140A and side walls 140B. Moreover, the width of front wall 140A may be less than the width of front face 41 in width direction 31. Detection portion 140 may be configured to receive light, e.g., visible or infrared light, emitted from an optical sensor 230, e.g., a photo interrupter, positioned in cartridge mounting portion 276. When ink cartridge 25 is mounted to cartridge mounting portion 276, a light emitting portion of optical sensor 230 faces one of side walls 140B and a light receiving portion of optical sensor 230 faces the other of the side walls 140B. Light emitted from the light emitting portion of optical sensor 230 may pass through side walls 140B and reach the light receiving portion of optical sensor 230.

Detection portion 140 may have an inner space 142 defined by front wall 140A, side walls 140B, top wall 140C, and bottom wall 140D. There may be no wall between inner space 142 and ink chamber 100, such that inner space 142 is in fluid communication with ink chamber 100. Pivotable member 70 may be positioned in ink chamber 100. Pivotable member 70 may comprise an indication portion 72 positioned at a first end of pivotable member 70, and a float 73 positioned at a second end of pivotable member 70 opposite the first end of pivotable member 70. Indication portion 72 may be configured to be positioned in inner space 142. Pivotable member 70 may extend from indication portion 72 to float 73 in a plane substantially parallel to height direction 32 and depth direction 33. Pivotable member 70 may comprise a shaft 66 positioned between indication portion 72 and float 73. Shaft 66 may extend in width direction 31. Both ends of shaft 66 may be supported by bearings (not shown) positioned at inner surfaces of pair of side walls 66, respectively, such that pivotable member 70 pivots about shaft 66. When pair of side walls 60 is a pair of flexible films, the bearings may not be positioned at inner surfaces of pair of side walls 66, and shaft 66 may be supported by the bearings positioned at frame 50.

Pivotable member 70 may comprise an opaque material. Pivotable member 70 may be manufactured by injection-molding a resin, e.g., nylon, polyethylene, polypropylene, polycarbonate, polyolefin, acrylic resin, or the like. A coloring agent, e.g., carbon black, may be added in the resin. Alternatively, at least indication portion 72 may comprise an opaque material, and other portions of pivotable member 70 may comprise a non-opaque material. When indication portion 72 receives light emitted from optical sensor 230, indication portion 72 may block the light. For example, indication portion 72 may prevent the light from passing therethrough, or may alter the path of the light. Alternatively, pivotable member 70 may comprise a reflective member, e.g., aluminum foil, positioned at indication portion 72, and when indication portion 72 receives light emitted from optical sensor 230, indication portion 72 reflects the light. In another embodiment, indicator portion 72 may sufficiently reduce the intensity of light passing therethrough.

The specific gravity of float 73 may be less than the specific gravity of ink in ink chamber 100. In an embodiment, float 73 has a hollow space formed therein. Float 73 may be configured to move up and down in accordance with an increase and a decrease in the amount of ink in ink chamber 100. In accordance with the movement of float 73, pivotable member 70 pivots about shaft 66, and in accordance with the pivot movement of pivotable member 70, indication portion 72 moves up and down in inner space 142.

Figure 3B:
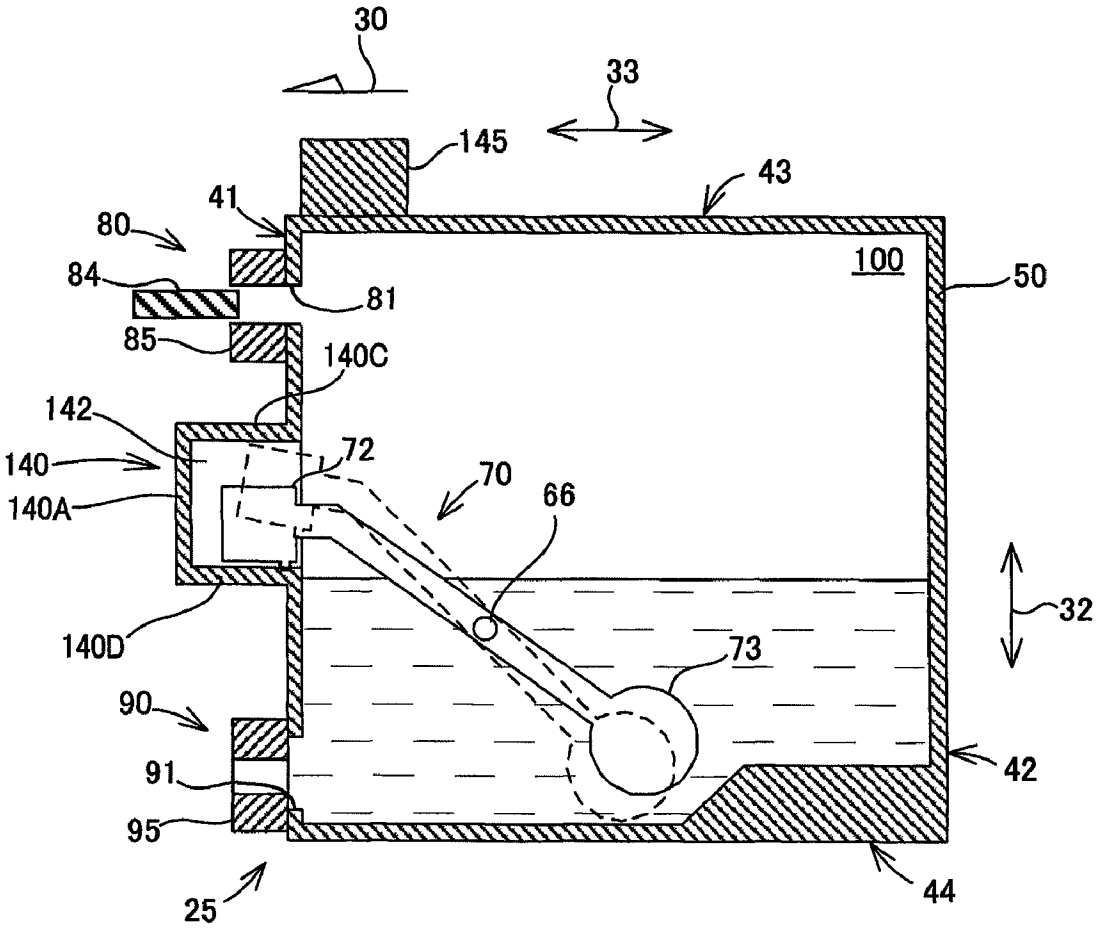
FIG. 3(B) is a side, cross-sectional view of the ink cartridge of FIGS. 2(A) and 2(B).

When ink chamber 100 has a sufficient amount of ink stored therein, indicator portion 72 is positioned in a first position in which indicator portion 72 contacts bottom wall 140D, as shown in solid line in FIG. 3(B). When ink chamber 100 does not have a sufficient amount of ink stored therein, indicator portion 72 is positioned in a second position in which indication portion 72 is separated from bottom wall 140D and contacts top wall 140C. In an embodiment, when ink cartridge 25 is mounted to cartridge mounting portion 276 and indicator portion 72 is positioned in the first position, indicator portion 72 blocks the light emitted from optical sensor 230. By monitoring whether indicator portion 72 is positioned in the first position from an exterior of detection portion 140, e.g., by optical sensor 230, it is determined that whether ink chamber 100 has a sufficient amount of ink stored therein.

A protrusion 145 may be positioned at top outer face 43 adjacent to front outer face 41. Protrusion 145 may have a plate shape having a depth in depth direction 33, a height in height direction 32, and a width in width direction 31, in which the depth of protrusion 145 is greater than the height of protrusion 145, and the height of protrusion 145 is greater than the width of protrusion 145.

Figure 3A:
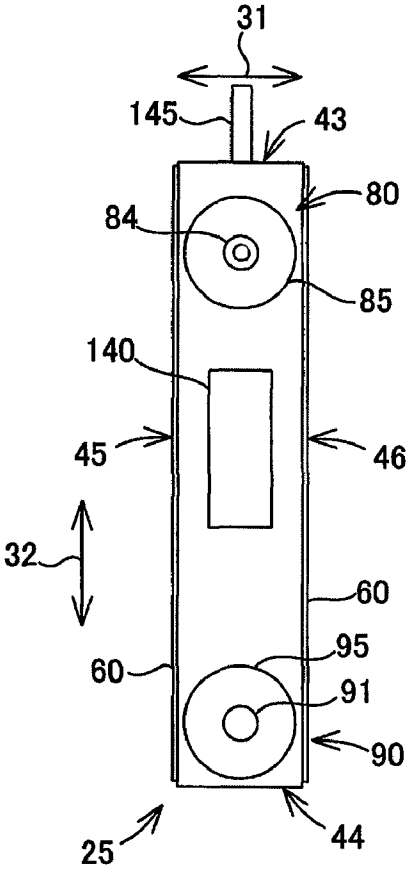
FIG. 3(A) is a front view of the ink cartridge of FIGS. 2(A) and 2(B)

An air communication portion 80 may be positioned at front outer face 41. When ink cartridge 25 is mounted to cartridge mounting portion 276, air communication portion 80 may be positioned above detection portion 140. Air communication portion 80 may have an opening 81 formed through front outer face 41 to draw air into ink chamber 100, a valve mechanism configured to selectively open and close opening 81 to selectively allow and prevent fluid communication between an interior and an exterior of ink chamber 100, and a cap 85 enclosing the valve mechanism. Cap 85 may be attached to front outer face 41 and may extend outward from front outer face 41 in a direction away from ink chamber 100, such that the valve mechanism is positioned adjacent to opening 81. For example, the valve mechanism of air communication portion 80 may be substantially the same as the valve mechanism described in JP-A-2007-144811 or US 2007/0070138 A1. Alternatively, the valve mechanism of air communication portion 80 may comprise a rod 84 extending to an exterior of cap 85. Only rod 84 is shown in FIG. 3, and other portions of the valve mechanism are omitted in FIG. 3. When no external force is applied to the valve mechanism, the valve mechanism closes opening 81, such that fluid communication between the interior and the exterior of ink chamber 100 via opening 81 is prevented. When an external force is applied to rod 84 toward ink chamber 100, rod 84 moves toward ink chamber 100 to cause the valve mechanism to open opening 81, such that fluid communication between the interior and the exterior of ink chamber 100 via opening 81 is allowed. When this occurs, air is drawn into ink chamber 100 via air communication portion 80.

Figure 5:
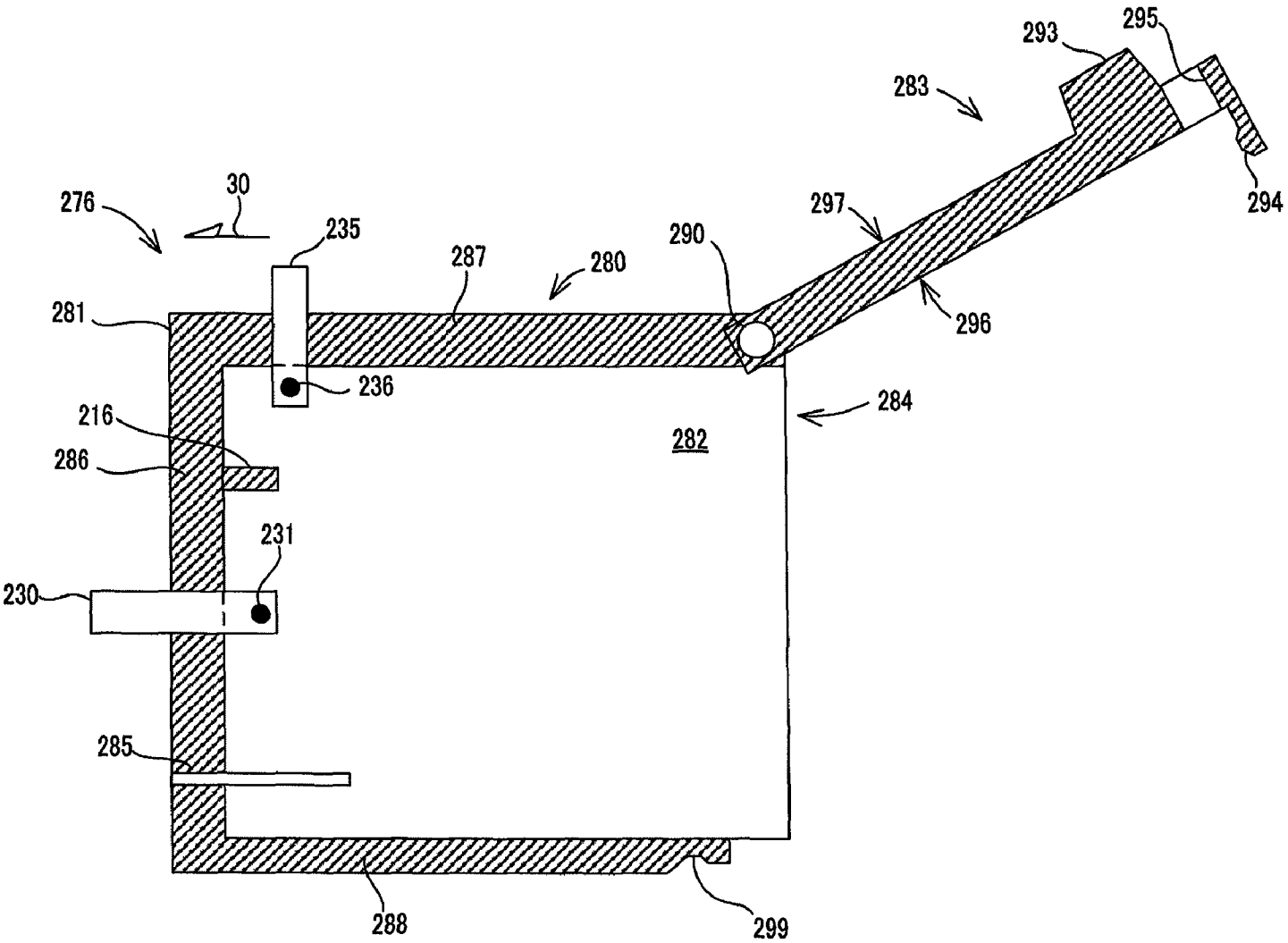
FIG. 5 is a side, partial, cross-sectional view of a cartridge mounting portion, according to an embodiment of the invention.

Ink supply portion 90 may be positioned at front outer face 41. When ink cartridge 25 is mounted to cartridge mounting portion 276, ink supply portion 90 may be positioned below detection portion 140. Ink supply portion 90 may have an opening 91 formed through front outer face 41 to supply ink from an interior of ink chamber 100 to an exterior of ink chamber 100, a valve mechanism (not shown) configured to selectively open and close opening 91, such that fluid communication between the interior and the exterior of ink chamber 100 via opening 91 is selectively allowed and prevented, and a cap 95 enclosing the valve mechanism. Cap 95 may be attached to front outer face 41 and may extend outward from front outer face 41 in a direction away from ink chamber 100, such that the valve mechanism is positioned adjacent to opening 91. For example, the valve mechanism of ink supply portion 90 may be substantially the same as the valve mechanism described in JP-A-2007-144811 or US 2007/0070138 A1. When no external force is applied to the valve mechanism of ink supply portion 90, the valve mechanism may close opening 91, such that fluid communication between the interior and the exterior of ink chamber 100 via opening 91 is prevented. Referring to FIG. 5, cartridge mounting portion 276 may comprise an ink pipe 285. When ink cartridge 25 is mounted to cartridge mounting portion 276, ink pipe 285 may enter cap 95, such that a portion of ink pipe 285 is positioned within ink supply portion 90, and ink pipe 285 applies a force to, e.g., pushes, the valve mechanism toward ink chamber 100. Consequently, the valve mechanism opens opening 91, such that ink is supplied from ink chamber 100 to ink pipe 285 via ink supply portion 90, and then is supplied to recording head 272 via tube 278.

Figure 4:
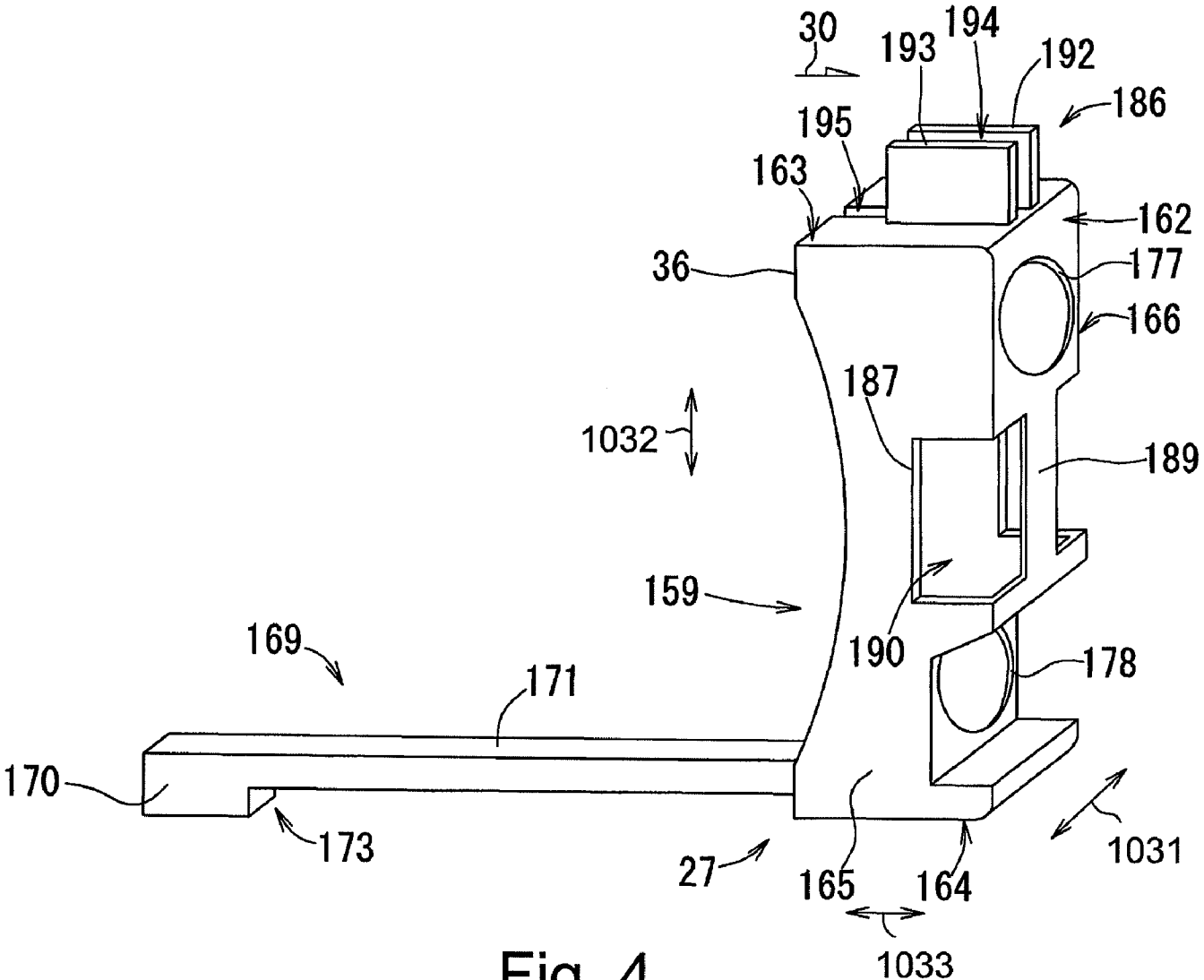
FIG. 4 is a perspective view of an adapter, according to an embodiment of the invention.

Referring to FIG. 4, an adapter 27 according to an embodiment of the invention is depicted. Adapter 27 may be used with ink cartridge 25 in cartridge mounting portion 276. Adapter 27 may indicate information associated with ink cartridge 25. Recording apparatus 250 may be configured to obtain the information from detection portions of adapter 27 using optical sensors 230 and 235. The information may indicate the color of or the amount of ink stored in ink cartridge 25, or may indicate the country in which ink cartridge 25 is intended to be sold.

Adapter 27 may comprise a main body 36, a detection portion 186, and an operation portion 169.

Figure 2B:
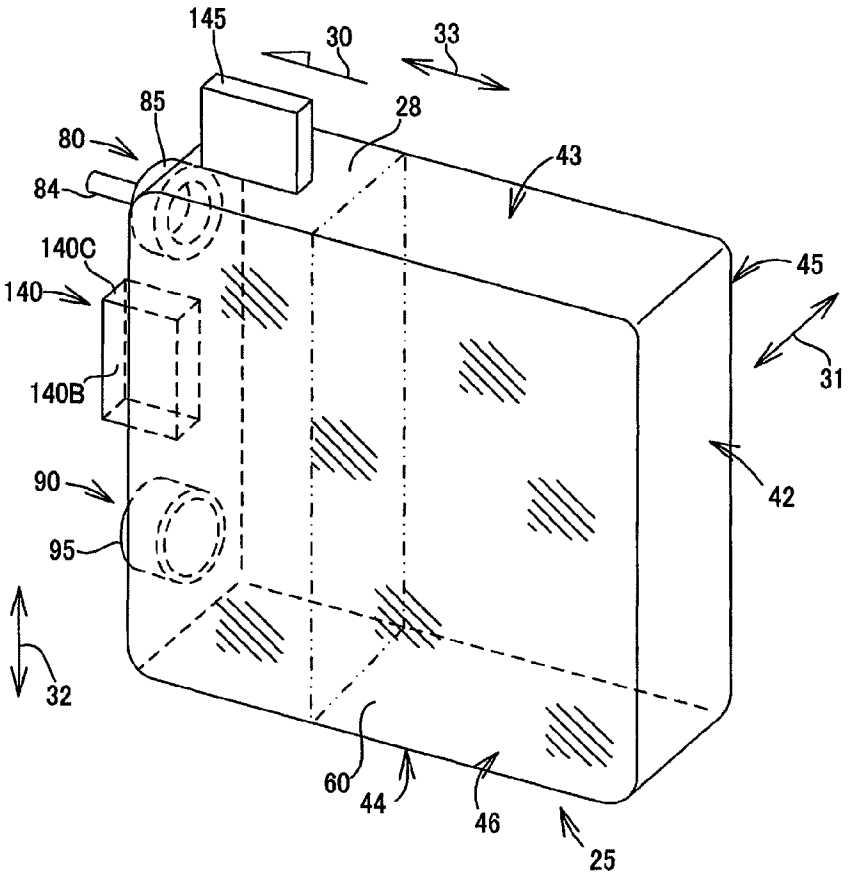
FIGS. 2(A) and 2(B) are perspective views of an ink cartridge, according to an embodiment of the invention.
Figure 2A:
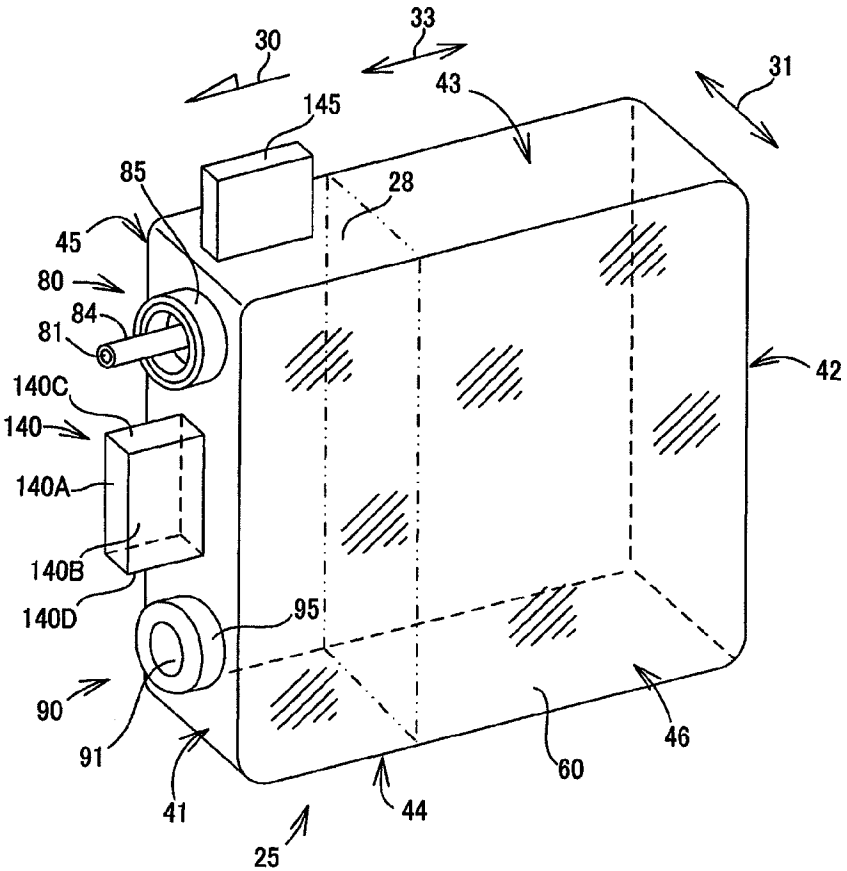

Referring to FIGS. 2(A) and 2(B), ink cartridge 25 may comprise a front portion 28 positioned between front outer face 41, and a particular portion indicated by an alternating long and two short dashed line. Front portion 28 may comprise air communication portion 80, detection portion 140, and ink supply portion 90. Referring again to FIG. 4, in an embodiment, main body 36 may have a container shape configured to accommodate front portion 28 of ink cartridge 25. In another embodiment, main body 36 may accommodate substantially the entirety of ink cartridge 25. In yet another embodiment, main body 36 may not accommodate any portions of ink cartridge 25.

Main body 36 may have a substantially rectangular, parallelepiped shape corresponding to the shape of front portion 28 of ink cartridge 25. Main body 36 has a width in a width direction, as indicated by an arrow 1031, a height in a height direction, as indicated by an arrow 1032, and a depth in a depth direction, as indicated by an arrow 1033. The height of main body 36 may be greater than each of the width and the depth of main body 36. Main body 36 may comprise a front wall 162, a top wall 163, a bottom wall 164 opposite top wall 163, a left side wall 165, and a right side wall 166 opposite left side wall 165. Each of top wall 163 and bottom wall 164 may be connected to front wall 162, and each of left side wall 165 and right side wall 166 may be connected to front wall 162, top wall 163, and bottom wall 164. Main body 36 has an opening 159 formed opposite front wall 162, and opening 159 is defined by ends of top wall 163, bottom wall 164, left side wall 165, and right side wall 166. Front wall 162, top wall 163, bottom wall 164, left side wall 165, and right side wall 166 may define a space therein, and the space may be opened to an exterior of main body 36 via opening 159. Front portion 28 of ink cartridge 25 may be configured to be inserted into the space of main body 36 via opening 159, and when adapter 27 and ink cartridge 25 are mounted to cartridge mounting portion 276, front portion 28 may be accommodated in the space of main body 36. When front portion 28 is accommodated in the space of main body 36, front wall 162 may face front outer face 41 and may cover at least a portion of front outer face 41, top wall 163 may face top outer face 43 and may cover at least a portion of top outer face 43, bottom wall 164 may face bottom outer face 44 and may cover at least a portion of bottom outer face 44, left side wall 165 may face left side outer face 45 and may cover at least a portion of left side outer face 45, and right side wall 166 may face right side outer face 46 and may cover at least a portion of right side outer face 46. When front portion 28 of ink cartridge 25 is inserted into the space of main body 36, the insertion of front portion 28 may be guided by inner surfaces of top wall 163, bottom wall 164, left side wall 165, and right side wall 166, such that ink cartridge 25 is inserted smoothly. Adapter 27 may be inserted into cartridge mounting portion 276 from front wall 162-side in insertion direction 30. When adapter 27 and ink cartridge 25 are mounted to cartridge mounting portion 276, width direction 1031, height direction 1032, and depth direction 1033 are parallel to width direction 31, height direction 32, and depth direction 33, respectively.

Main body 36 may have a cut-out 187 formed though front wall 162, left side wall 165, and right side wall 166. When ink cartridge 25 is accommodated in main body 36, detection portion 140 may be exposed to the exterior of main body 36 via cut-out 187. Therefore, cut-out 187 may be formed at a position corresponding to front wall 140A and pair of side walls 140B, and may have a shape and a size corresponding to front wall 140A and pair of side walls 140B. A shape of cut-out 187 at front wall 162, as seen from a direction perpendicular to front wall 162, may be rectangular. A shape of cut-out 187 at left side wall 165, as seen from a direction perpendicular to left side wall 165, also may be rectangular. Moreover, a shape of cut-out 187 at right side wall 166, as seen from a direction perpendicular to right side wall 166, may be rectangular.

Adapter 27 may comprise an opaque material. Adapter 27 may be manufactured by injection-molding a resin, e.g., nylon, polyethylene, polypropylene, polycarbonate, polyolefin, or acrylonitrile butadiene styrene. A coloring agent, e.g., carbon black, may be added in the resin.

Main body 36 integrally may comprise detection portion 186, and detection portion 186 may comprise a pair of protrusions 192, 193. Protrusions 192, 193 may be positioned at top wall 163. Protrusions 192, 193 may extend from top wall 163 in a direction perpendicular to top wall 163. Each of protrusions 192, 193 may have a plate shape having a depth in depth direction 1033, a height in height direction 1032, and a width in width direction 1031, in which the height of each of protrusions 192, 193 is greater than the width of each of protrusions 192, 193, and the depth of each of protrusions 192, 193 is greater than the height of each of protrusions 192, 193. When adapter 27 is inserted into cartridge mounting portion 276 and mounted to cartridge mounting portion 276, detection portion 186 may be positioned in an optical path 236 of an optical sensor 235 provided in cartridge mounting portion 276, and may block light emitted from optical sensor 235. Optical path 236 may be formed between a light emitting portion and a light receiving portion of optical sensor 235. The light emitting portion and the light receiving portion of optical sensor 235 may face each other. Because adapter 27 may comprise an opaque material, detection portion 186 may block light, e.g., visible or infrared light, emitted from the light emitting portion. For example, when detection portion 186 is positioned in optical path 236 of optical sensor 235, detection portion 186 may prevent the light of optical sensor 235 from passing therethrough. Alternatively, adapter 27 may comprise a reflective member, e.g., aluminum foil, positioned at detection portion 186, and when detection portion 186 receives light emitted from optical sensor 235, detection portion 186 reflects the light. Optical sensor 235 may be electrically connected to a controller (not shown) of recording apparatus 250. When the light emitted from the light emitting portion is not blocked, the intensity of the light reaching the light receiving portion is greater than a threshold value. When detection portion 186 blocks the light emitted from the light emitting portion, the intensity of the light reaching the light receiving portion may be less than the threshold value. When the intensity of the light reaching the light receiving portion is less than the threshold value, optical sensor 235 may output a signal to the controller, and the controller may determine that adapter 27 is mounted to cartridge mounting portion 276. Protrusion 192 and protrusion 193 may be aligned in width direction 1031, and a gap 194 may be formed therebetween. Top wall 163 may have a slit 195 formed therethrough extending from opening 159 in depth direction 1033. Slit 195 may be continuous with gap 194.

Main body 36 may comprise a bridge portion 189 which is positioned at front wall 162 and spans cut-out 187 in height direction 1032. Bridge portion 189 may have a plate shape having a depth in depth direction 1033, a height in height direction 1032, and a width in width direction 1031, in which the width of bridge portion 189 is greater than the depth of bridge portion 189, and the height of bridge portion 189 is greater than the width of bridge portion 189. Bridge portion 189 may divide cut-out 187 into two openings 190. When bridge portion 189 is inserted into cartridge mounting portion 276, bridge portion 189 may pass an optical path 231 of optical sensor 230, and may block light emitted from optical sensor 230. Optical path 231 may be formed between a light emitting portion and a light receiving portion of optical sensor 230. The light emitting portion and the light receiving portion of optical sensor 230 may face each other. Because adapter 27 may comprise an opaque material, bridge portion 189 may block light, e.g., visible or infrared light, emitted from the light emitting portion. For example, when bridge portion 189 is positioned in optical path 231 of optical sensor 230, bridge portion 189 may prevent the light of optical sensor 230 from passing therethrough. Alternatively, adapter 27 may comprise a reflective member, e.g., aluminum foil, positioned at bridge portion 189, and when bridge portion 189 receives light emitted from optical sensor 230, bridge portion 189 may reflect the light. When the insertion of adapter 27 into the cartridge mounting portion 276 is complete, the light emitting portion and the light receiving portion of optical sensor 230 may face openings 190, respectively, such that the light emitted from the light emitting portion may reach the light receiving portion though openings 190. Optical sensor 230 may be electrically connected to a controller (not shown) of recording apparatus 230. When the light emitted from the light emitting portion is not blocked, the intensity of the light reaching the light receiving portion may be greater than a threshold value. When bridge portion 189 blocks the light emitted from the light emitting portion, the intensity of the light reaching the light receiving portion may be less than the threshold value. When the intensity of the light reaching the light receiving portion is less than the threshold value, optical sensor 230 may output a signal to the controller.

The depth of bridge portion 189 may depend on a characteristic of ink cartridge 25 which is to be used with adapter 27, e.g., the color of or the initial amount of ink stored in ink chamber 100 of ink cartridge 25 which is to be used with adapter 27. In an embodiment, two types of ink cartridge 25 may be used. One type of ink cartridge 25 may store a relatively small initial amount of ink in ink chamber 100, and another type of ink cartridge 25 may store a relatively large initial amount of ink in ink chamber 100. The depth of bridge portion 189 of adapter 27 to be used with ink cartridge 25 storing the relatively large initial amount of ink may be greater than the depth of bridge portion 189 of adapter 27 to be used with ink cartridge 25 storing the relatively small initial amount of ink. Alternatively, one type of ink cartridge 25 may store a black ink in ink chamber 100, and another type of ink cartridge 25 may store ink of a color other than black in ink chamber 100. The depth of bridge portion 189 of adapter 27 to be used with ink cartridge 25 storing the black ink may be greater than the depth of bridge portion 189 of adapter 27 to be used with ink cartridge 25 storing the color ink.

Front wall 162 may have a circular opening 177 formed therethrough in depth direction 1033. Opening 177 may be positioned adjacent to top wall 163. The space defined by front wall 162, top wall 163, bottom wall 164, left side wall 165, and right side wall 166 may be opened to the exterior of main body 36 via opening 177. Opening 177 may be formed at a position corresponding to air communication portion 80. Referring to FIG. 5, cartridge mounting portion 276 may comprise a pushing portion 216, and the diameter of opening 177 may be sufficient to allow pushing portion 216 to be inserted through opening 177. When adapter 27 is mounted to cartridge mounting portion 276, a portion of pushing portion 216 may be positioned within opening 177. Then, when ink cartridge 25 is inserted into cartridge mounting portion 276, pushing portion 216 may apply a force to rod 84 to push rod 84 toward ink chamber 100 to cause the valve mechanism of air communication portion 80 to open.

Referring again to FIG. 4, front wall 162 may have a circular opening 178 formed therethrough in depth direction 1033. Opening 178 may be positioned adjacent to bottom wall 164. The space defined by front wall 162, top wall 163, bottom wall 164, left side wall 165, and right side wall 166 may be opened to the exterior of main body 36 via opening 178. Opening 178 may be formed at a position corresponding to ink supply portion 90. The diameter of opening 178 may be sufficient to allow ink supply portion 90 to be inserted through opening 178. When adapter 27 and ink cartridge 25 are mounted to cartridge mounting portion 276, a portion of ink supply portion 90 may be positioned within opening 178, and a portion of ink pipe 285 may be positioned within ink supply portion 90.

Operation portion 169 may have a substantially rectangular, parallelepiped shape having a depth in depth direction 1033, a height in height direction 1032, and a width in width direction 1033, in which the depth of operation portion 169 is greater than each of the height and the width of operation portion 169. The width of operation portion 169 may be less than the width of main body 36. Operation portion 169 may extend from bottom wall 164 in a direction away from main body 36. Operation portion 169 may comprise an extending portion 171 and a grasp portion 170. Extending portion 171 may have a first end connected to main body 36 and a second end opposite the first end of extending portion 171. Grasp portion 170 may be connected to the second end of extending portion 171. A user 170 may hold grasp portion 170. Each of grasp portion 170 and extending portion 171 has a height in height direction 1032, and the height of grasp portion 170 may be greater than the height of extending portion 171. Each of grasp portion 170 and extending portion 171 has a top surface and a bottom surface opposite the bottom surface. When adapter 27 is mounted to cartridge mounting portion 276, the top surface of each of grasp portion 170 and extending portion 171 may be positioned above the bottom surface of each of grasp portion 170 and extending portion 171. The top surface of grasp portion 170 may be flush with the top surface of extending portion 171, and the bottom surface of grasp portion 170 may be offset from the bottom surface of extending portion 171, such that the bottom surface of grasp portion 170 is connected to the bottom surface of extending portion via a connecting surface 173 extending in height direction 1032. In another embodiment, operation portion 169 may not be connected to bottom wall 164, and may be connected to top wall 163, left side face 165, or right side wall 166.

Referring to FIGS. 5-13, cartridge mounting portion 276 according to an embodiment of the invention is depicted. Cartridge mounting portion 276 may comprise at least one case 280, e.g., four cases 280, corresponding to four ink cartridges 25, respectively. Case 280 may comprise a main body 281 and a lock lever 283. Main body 281 may have an accommodating chamber 282 formed therein. Accommodating chamber 282 may be configured to receive and to accommodate ink cartridge 25 and adapter 27. Case 280 may have an opening 284 formed therethrough and a end wall 286 positioned opposite opening 284. Adapter 27 may be inserted into accommodating chamber 282 via opening 284 to be positioned to contact end wall 286 with front wall 162 facing end wall 286, and then ink cartridge 25 may be inserted into accommodating chamber 282 via opening 284, such that front portion 28 of ink cartridge 25 is positioned in main body 36 of adapter 27.

Case 280 may comprise optical sensor 230 and optical sensor 235, e.g., photo interrupters. Optical sensor 230 may be positioned at end wall 286 of case 280. Case 280 may comprise a top wall 287 and a bottom wall 288 opposite top wall 287, and optical sensor 235 may be positioned at top wall 287 adjacent to end wall 286. Each of optical sensor 230 and optical sensor 235 may comprise a light emitting portion and a light receiving portion. Each of optical sensor 230 and optical sensor 235 may be connected to a controller (not shown) of recording apparatus 250, and may be configured to not output an electric signal to the controller when the light receiving portion receives light having an intensity which is greater than or equal to a threshold value, and to output the electric signal to the controller when the light receiving portion receives light having an intensity which is less than the threshold value. Optical path 231 may be formed between the light emitting portion and the light receiving portion of optical sensor 230. The light emitting portion and the light receiving portion of optical sensor 230 may be aligned in a direction perpendicular to the paper plane of FIG. 5, and the light emitting portion and the light receiving portion of optical sensor 230 may face each other. Similarly, optical path 236 may be formed between the light emitting portion and the light receiving portion of optical sensor 235. The light emitting portion and the light receiving portion of optical sensor 235 may be aligned in a direction perpendicular to the paper plane of FIG. 5, and the light emitting portion and the light receiving portion of optical sensor 235 may face each other.

When bridge portion 189 or indication portion 72 is positioned in optical path 231, the light emitted from the light emitting portion of optical sensor 230 may be blocked, and the light receiving portion of optical sensor 230 may receive light having an intensity which is less than the threshold value, e.g., zero intensity. Similarly, when detection portion 186 is positioned in optical path 236, the light emitted from the light emitting portion of optical sensor 235 may be blocked, and the light receiving portion of optical sensor 235 may receive light having an intensity which is less than the threshold value, e.g., zero intensity.

Case 280 may comprise ink pipe 285 extending from end wall 286 toward opening 284 in a direction opposite insertion direction 30. Ink pipe 285 may penetrate through end wall 286, and an end of ink pipe 285 may be exposed to the exterior of main body 281. Tube 278 may be connected to the end of ink pipe 285. When ink cartridge 25 is accommodated in accommodating chamber 282, ink pipe 285 may enter ink supply portion 90, such that the valve mechanism of ink supply portion 90 is opened by ink pipe 285. When the valve mechanism of ink supply portion 90 is opened by ink pipe 285, ink chamber 100 may be brought into fluid communication with ink pipe 285, and ink may be allowed to be supplied from ink chamber 100 to recording head 272 via opening 91, ink pipe 285, and tube 278.

Case 280 may comprise a pushing portion 216 extending from end wall 286 toward opening 284 in a direction opposite insertion direction 30. When adapter 27 is inserted into accommodating chamber 282, pushing portion 216 may be inserted through opening 177. Then, when ink cartridge 25 is inserted into accommodating chamber 282, pushing portion 216 may apply a force to rod 84 to push rod 84 toward ink chamber 100 to cause the valve mechanism of air communication portion 80 to open.

Lock lever 283 may be configured to be selectively opened and closed to selectively cover and uncover opening 284.

When adapter 27 and ink cartridge 25 are accommodated in accommodating chamber 282, and lock lever 283 may be closed, and adapter 27 and ink cartridge 25 may be securely retained in accommodating chamber 282 by lock lever 283. Case 280 may comprise a shaft 290 positioned directly above opening 284, and a first end of lock lever 283 may be coupled to shaft 290, such that lock lever 283 pivots about shaft 290. Lock lever 283 has an inner surface 296 and an outer surface 297 opposite inner surface 296. When lock lever 283 covers opening 284, inner surface 296 may face accommodating chamber 282. Lock lever 283 may comprise an operation portion 293, and a claw 294. Claw 294 may be positioned at inner surface 296 and at a second end of lock lever 283 opposite the first end of lock lever 283. Operation portion 293 may be positioned at outer surface 297 adjacent to the second end of lock lever 283. Lock lever 290 may have an opening 295 extending from inner surface 296 to outer surface 297 and positioned adjacent to the second end of lock lever 283. Case 280 may have a groove 299 formed therein at a position below opening 284, and groove 299 may be configured to engage claw 294.

Referring to FIGS. 6-13, adapter 27 and ink cartridge 25 may be inserted into accommodating chamber 282 and mounted to case 280 in the following manner.

Figure 6:
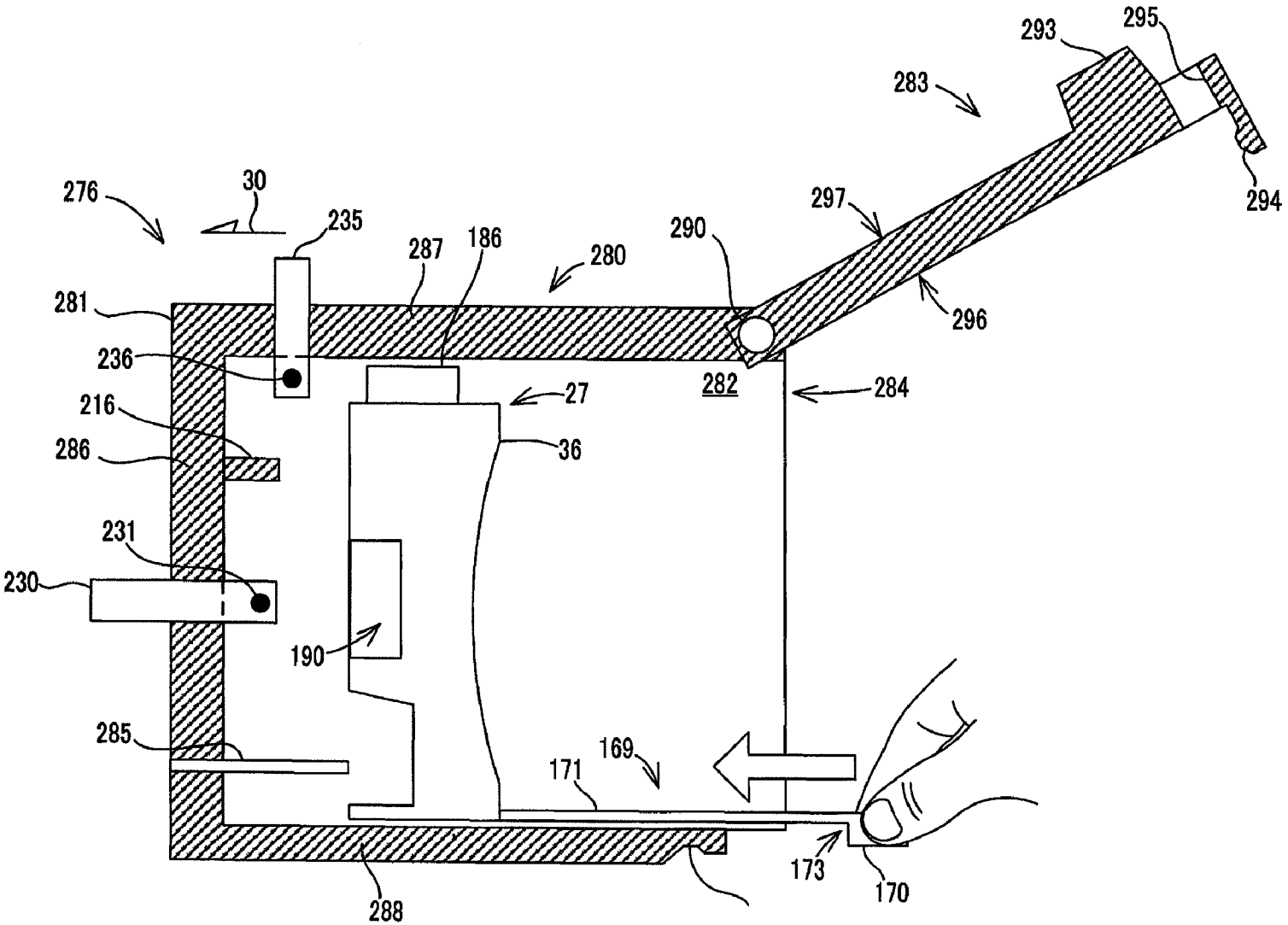
FIG. 6 is a side, partial, cross-sectional view of the cartridge mounting portion of FIG. 5 and the adapter of FIG. 4, in which the adapter is being inserted into the cartridge mounting portion.
Figure 7:
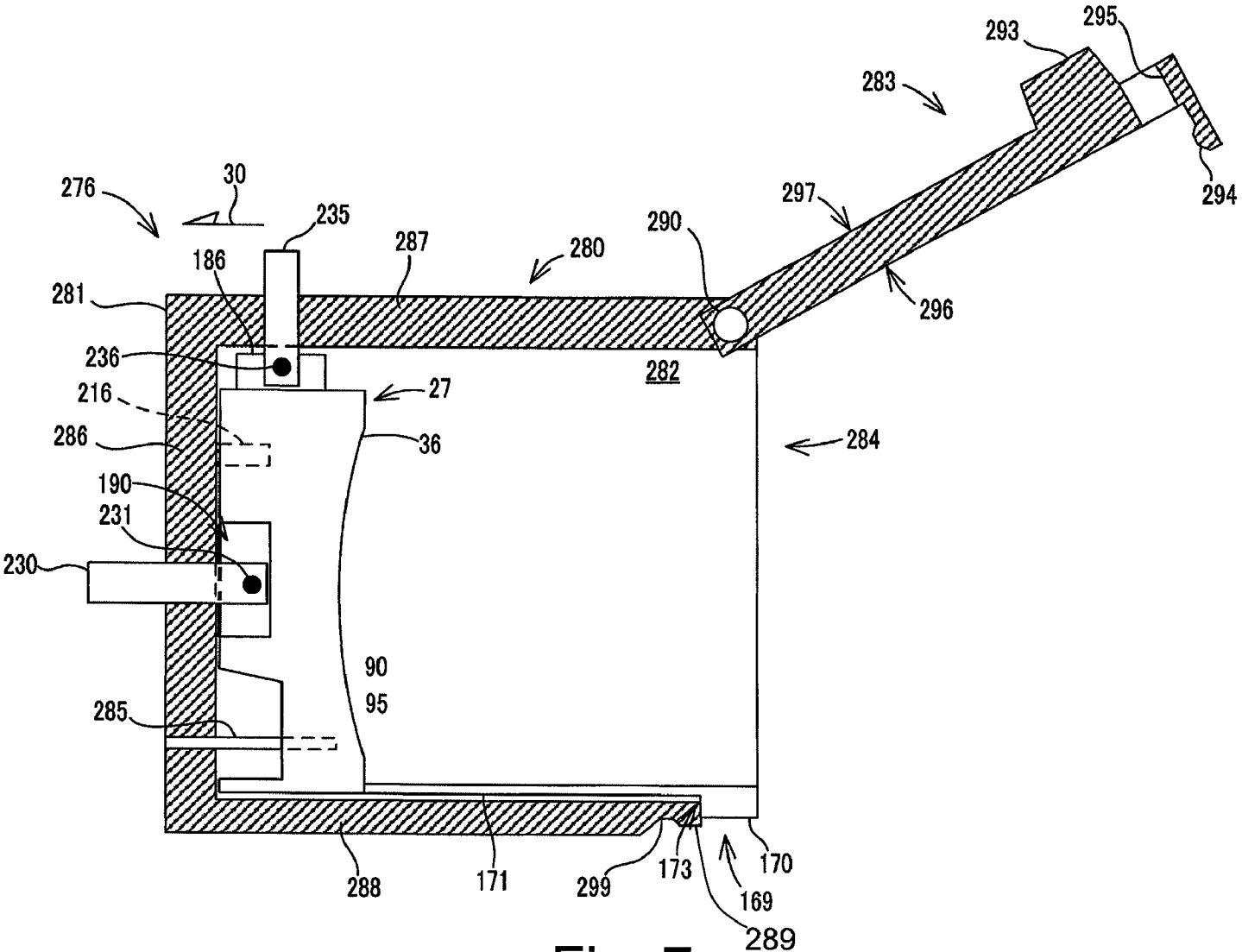
FIG. 7 is a side, partial, cross-sectional view of the cartridge mounting portion of FIG. 5 and the adapter of FIG. 4, in which the insertion of the adapter into the cartridge mounting portion is complete.

When a user intends to insert adapter 27 into accommodating chamber 282, the user holds grasp portion 170, as shown in FIG. 6, and inserts adapter 27 into accommodating chamber 282 from front wall 162-side via opening 284 toward end wall 286. Bridge portion 189 first enters optical path 231 of optical sensor 230, and then when adapter 27 is further inserted, detection portion 186 enters optical path 236 of optical sensor 235. If adapter 27 is used with ink tank 25 storing the relatively large initial amount of ink or storing the black ink, the depth of bridge portion 189 is sufficiently long enough that bridge portion 189 still is positioned in optical path 231 of optical sensor 230 when detection portion 186 initially enters optical path 236 of optical sensor 235. In contrast, if adapter 27 is used with ink tank 25 storing the relatively small initial amount of ink or storing the color ink, the depth of bridge portion 189 is sufficiently short enough that bridge portion 189 already has passed optical path 231 of optical sensor 230 and is not positioned in optical path 231 of optical sensor 230 when detection portion 186 initially enters optical path 236 of optical sensor 235. The controller determines which type of ink tank 25 is to be mounted based on the output of optical sensor 230 when detection portion 186 initially enters optical path 236 of optical sensor 235. When adapter 27 is further inserted, adapter 27 contacts end wall 286, as shown in FIG. 7, which completes the insertion of adapter 27. When adapter 27 contacts end wall 286, detection portion 186 is positioned in optical path 236 of optical sensor 235, optical path 231 of optical sensor 230 is positioned through openings 190, and a portion of pushing portion 216 is positioned within opening 177, as shown in FIG. 7. Moreover, when adapter 27 contacts end wall 286, operation member 169 extends from bottom wall 164 of main body 36 to opening 284, such that grasp portion 170 is positioned outside accommodating chamber 282, and connecting surface 173 contacts an end surface 289 of bottom wall 288 positioned opposite end wall 286. The controller determines whether adapter 27 is mounted in case 280 based on the output of optical sensor 235.

Figure 8:
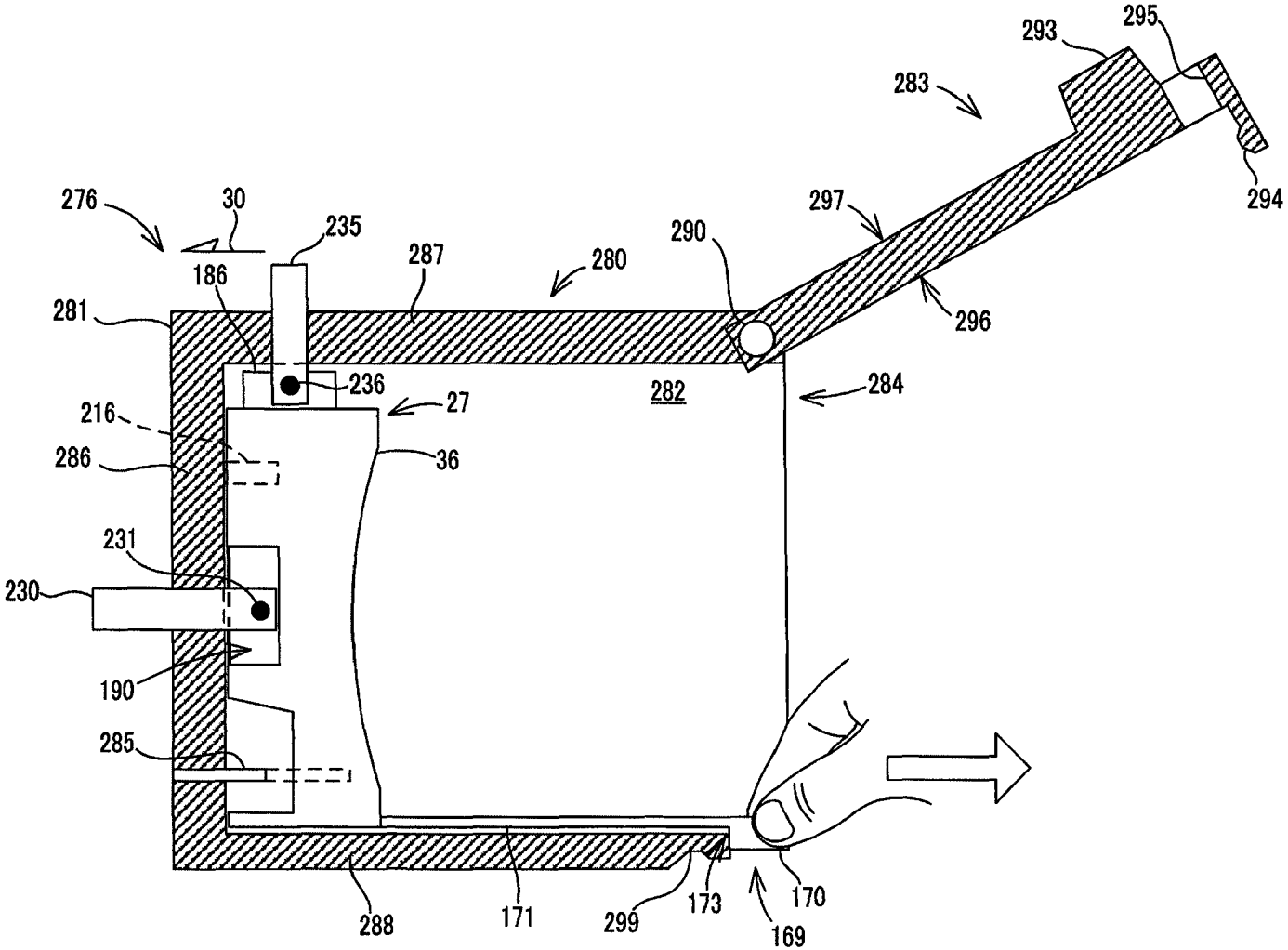
FIG. 8 is a side, partial, cross-sectional view of the cartridge mounting portion of FIG. 5 and the adapter of FIG. 4, in which the adapter is being removed from the cartridge mounting portion.

When a user intends to remove adapter 27 from case 280 before inserting ink cartridge 25 into accommodating chamber 282, the user holds grasp portion 170, as shown in FIG. 8, and pulls adapter 27 in a direction opposite insertion direction 30.

Figure 9:
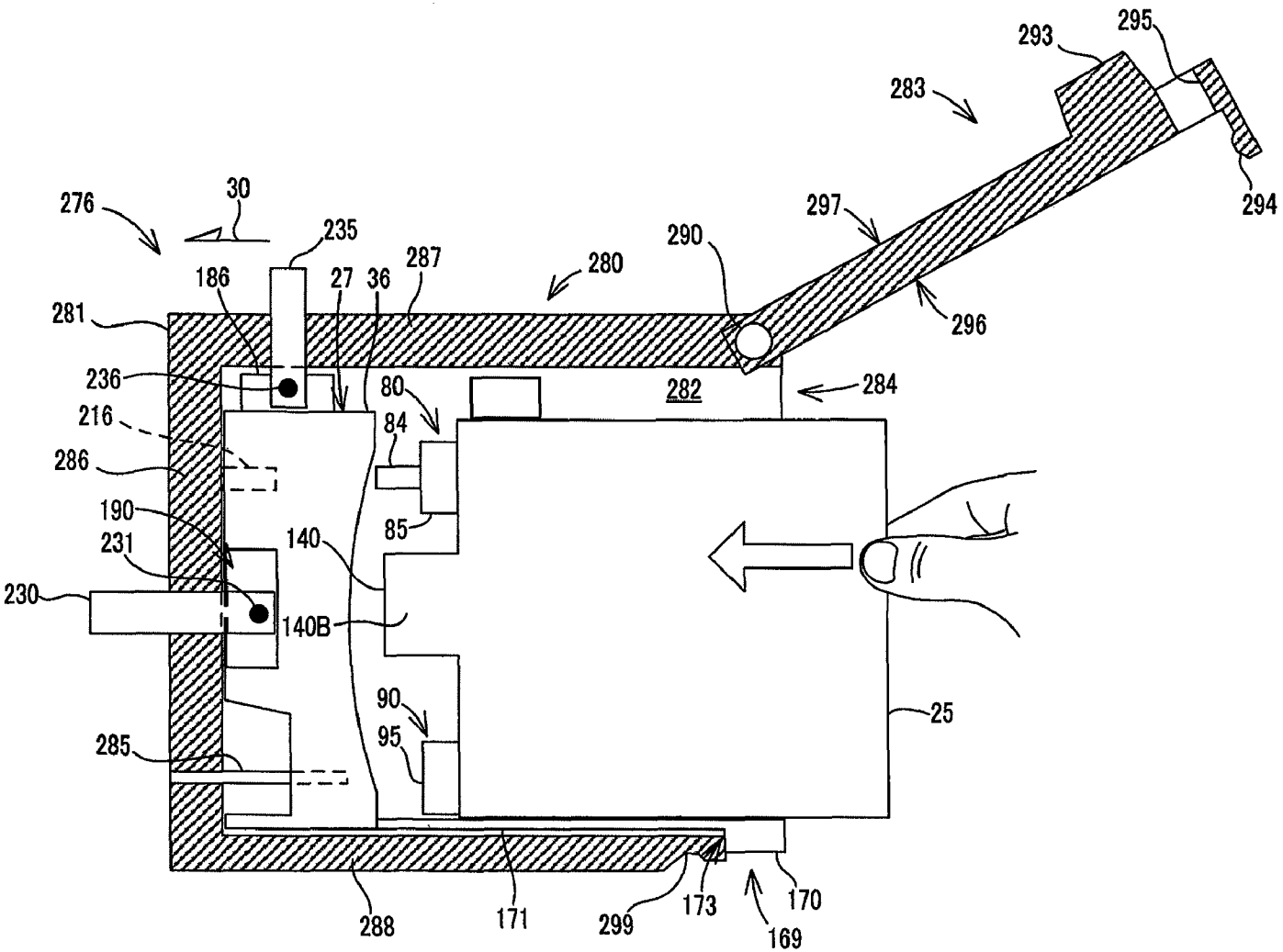
FIG. 9 is a side, partial, cross-sectional view of the cartridge mounting portion of FIG. 5, the adapter of FIG. 4, and the ink cartridge of FIGS. 2(A) and 2(B), in which the insertion of the adapter into the cartridge mounting portion is complete, and the ink cartridge is being inserted into the cartridge mounting portion.

After the insertion of adapter 27 into accommodating chamber 282 is completed, ink cartridge 25 is inserted into accommodating chamber 282 from front outer face 41-side via opening 284 toward end wall 286 while bottom outer surface 44 sliding on the top surface of extending portion 171, as shown in FIG. 9, and then front portion 28 of ink cartridge 25 is inserted into the space of main body 36 of adapter 27 via opening 159 of main body 36 of adapter 27.

Figure 10:
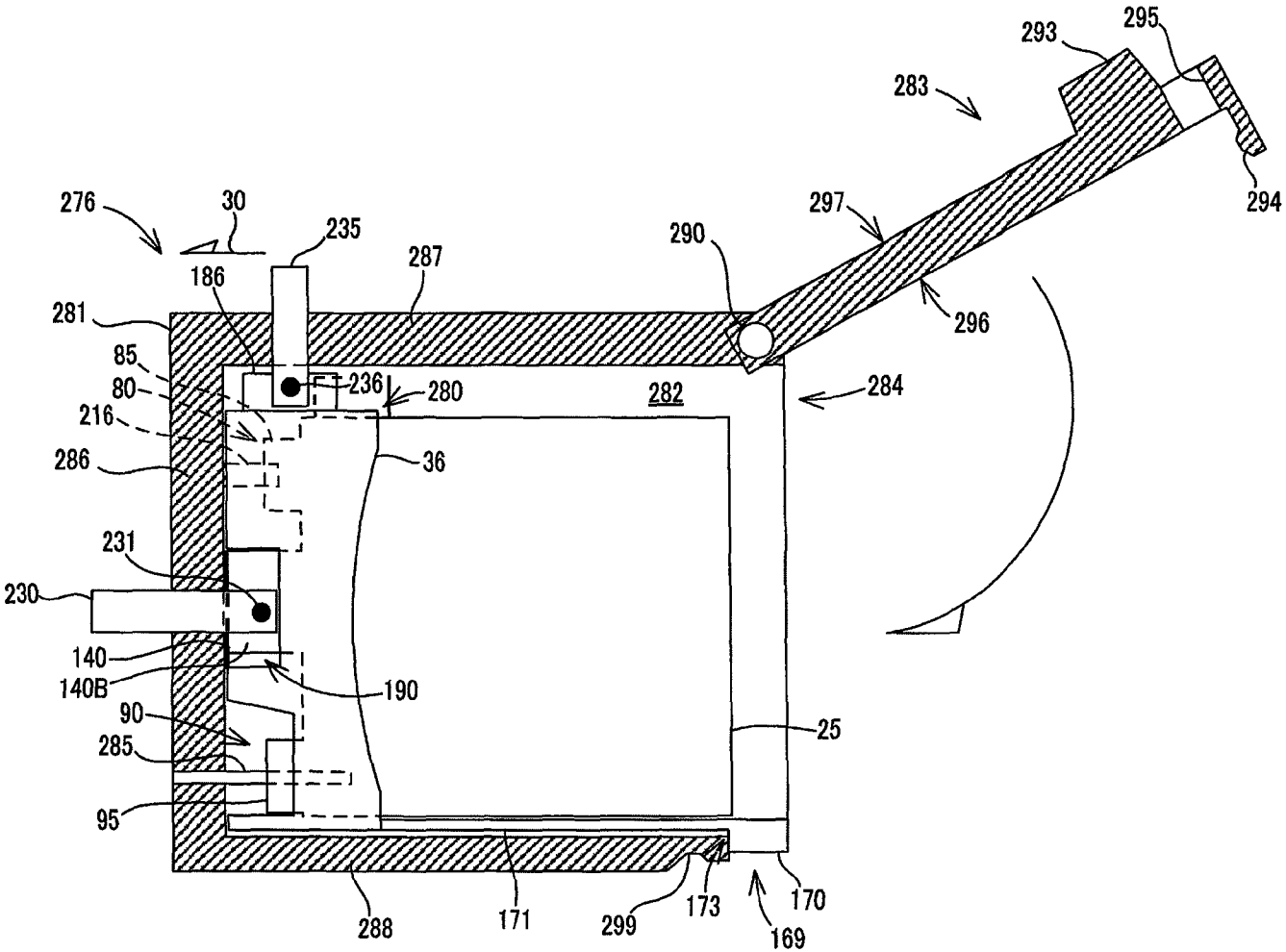
FIG. 10 is a side, partial, cross-sectional view of the cartridge mounting portion of FIG. 5, the adapter of FIG. 4, and the ink cartridge of FIGS. 2(A) and 2(B), in which the insertion of the adapter into the cartridge mounting portion is complete, and the insertion of the ink cartridge into the cartridge mounting portion is complete.

During the insertion of ink cartridge 25, protrusion 145 is inserted into gap 194 and slit 195. Pushing portion 216 then applies a force to rod 84, e.g., contacts and pushes rod 84, toward ink chamber 100 to cause the valve mechanism of air communication portion 80 to open. Ink chamber 100 is brought into fluid communication with the atmosphere via opening 81, and air is drawn into ink chamber 100 via air communication portion 80. Ink supply portion 90 then enters opening 178, and ink pipe 285 enters ink supply portion 90, such that the valve mechanism of ink supply portion 90 is opened by ink pipe 285. Ink chamber 100 is brought into fluid communication with ink pipe 285, and ink is supplied from ink chamber 100 to recording head 272 via opening 91, ink pipe 285, and flexible tube 278. When ink cartridge 25 is inserted to the end, detection portion 140 is exposed to the exterior of main body 36 of adapter 27 via openings 190, and detection portion 140 is positioned in optical path 231 of optical sensor 230, as shown in FIG. 10. When indication portion 72 is positioned in optical path 231, the controller of recording apparatus 250 determines that ink chamber 100 has a sufficient amount of ink therein, and when indication portion 72 is not positioned in optical path 231, the controller determines that ink chamber 100 does not have a sufficient amount of ink therein, based on the output from optical sensor 230.

Figure 11:
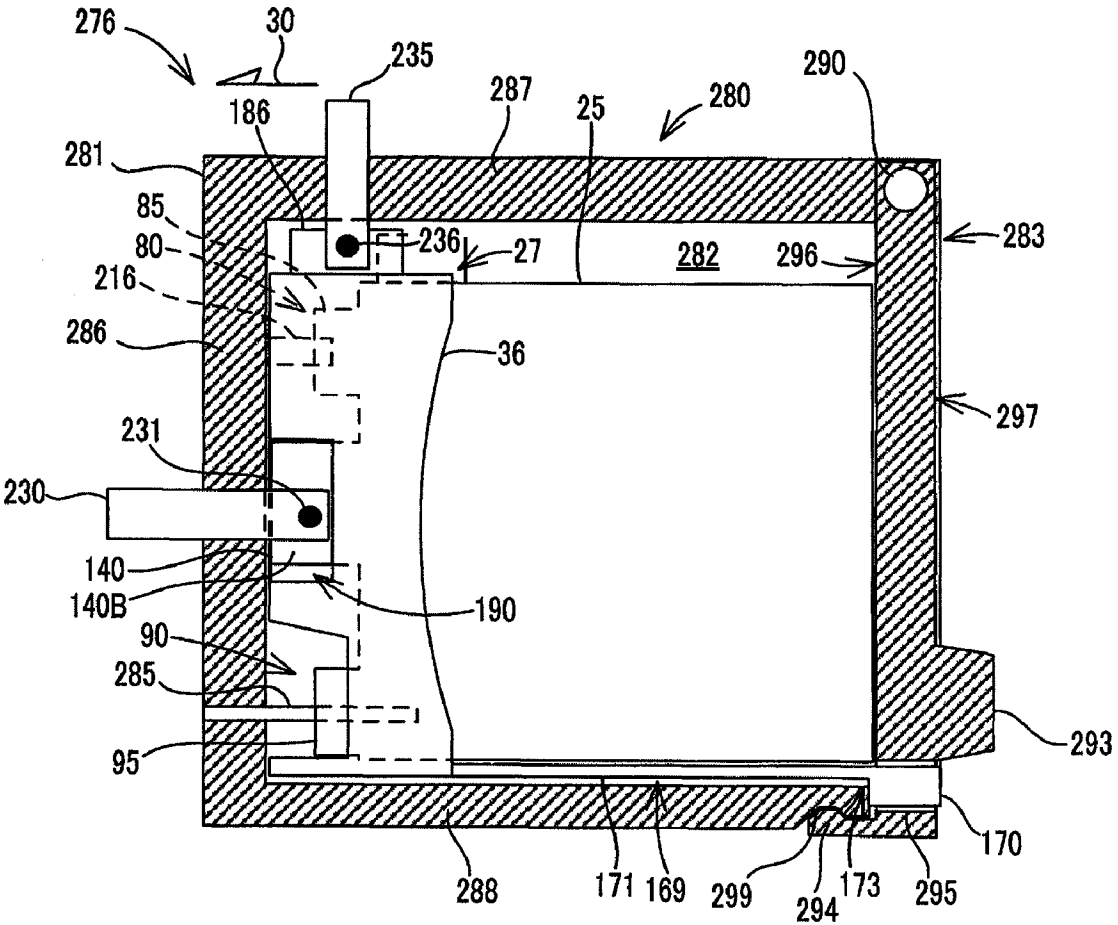
FIG. 11 is a side, partial, cross-sectional view of the cartridge mounting portion of FIG. 5, the adapter of FIG. 4, and the ink cartridge of FIGS. 2(A) and 2(B), in which the insertion of the adapter into the cartridge mounting portion is complete, the insertion of the ink cartridge into the cartridge mounting portion is complete, and a lock lever of the cartridge mounting portion is secured to a case of the cartridge mounting portion.

Subsequently, lock lever 283 pivots toward opening 284 by a user pushing operation portion 293. When the second end of lock lever 283 moves toward groove 299 and claw 294 engages groove 299, lock lever 283 is closed and secured to main body 281, as shown in FIG. 11. After lock lever 283 is closed, rear outer face 42 of ink cartridge 25 contacts inner surface 296 of lock lever 283, and therefore, ink cartridge 25 is securely retained in case 280. Grasp portion 170 is positioned in opening 295 of lock lever 283.

Figure 12:
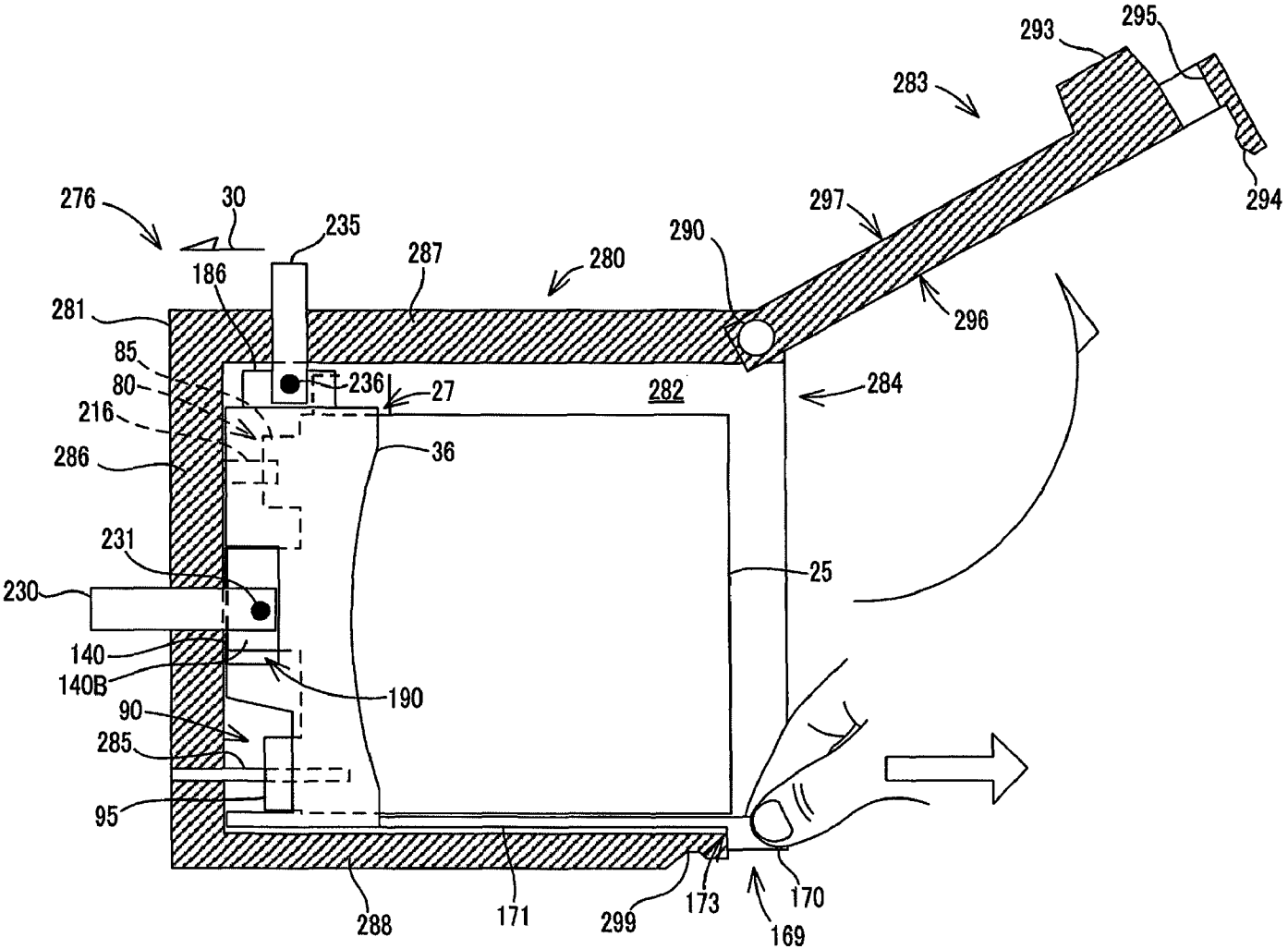
FIG. 12 is a side, partial, cross-sectional view of the cartridge mounting portion of FIG. 5, the adapter of FIG. 4, and the ink cartridge of FIGS. 2(A) and 2(B), in which the removal of the adapter and the ink cartridge is initiated.
Figure 13:
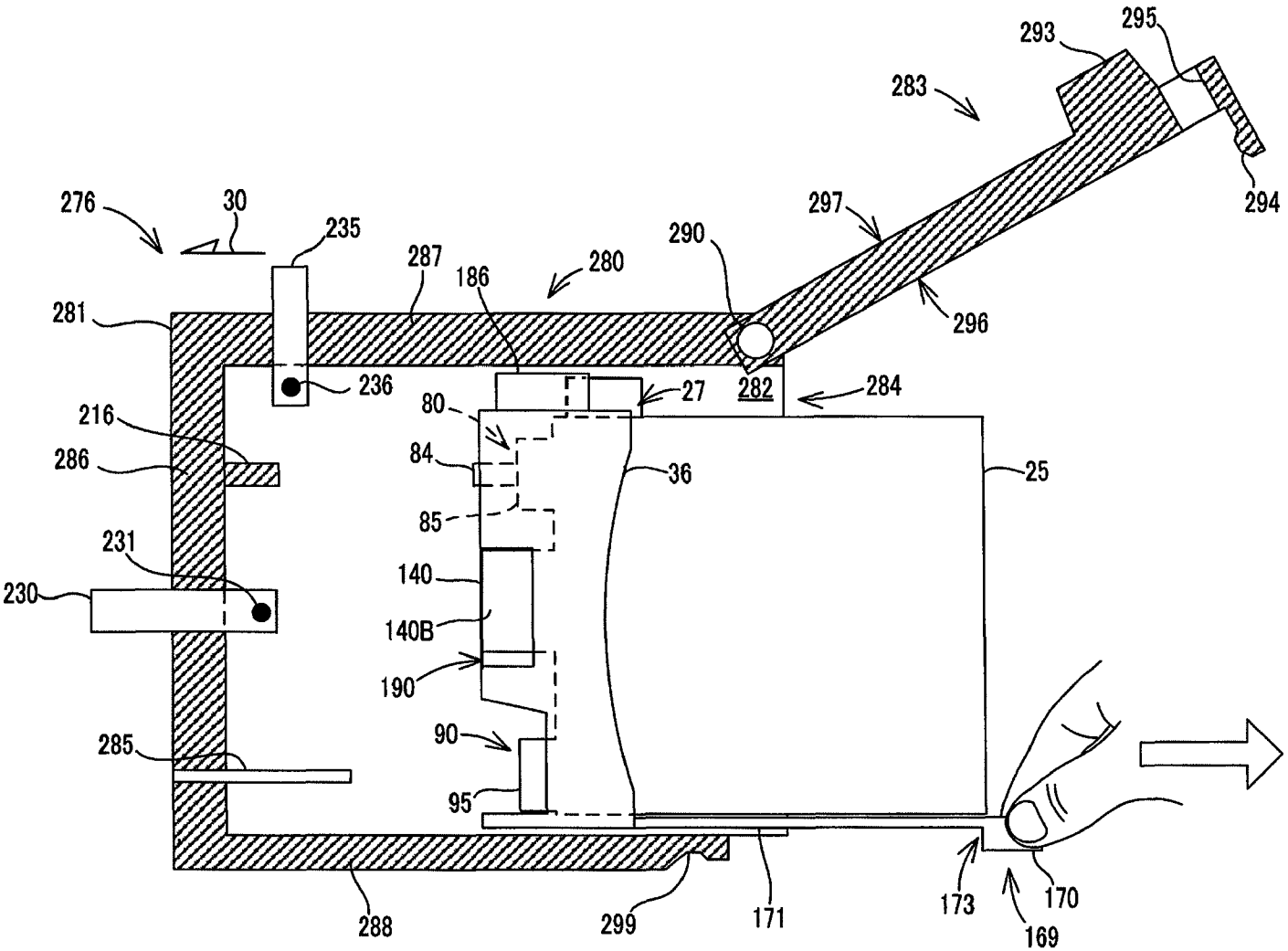
FIG. 13 is a side, partial, cross-sectional view of the cartridge mounting portion of FIG. 5, the adapter of FIG. 4, and the ink cartridge of FIGS. 2(A) and 2(B), in which the adapter and the ink cartridge are being removed.

When ink cartridge 25 is removed from case 280, a user disengages claw 294 from groove 299, and causes lock lever 283 to pivot upward. The user holds grasp portion 170, as shown in FIG. 12, and pulls adapter 27 in a direction opposite insertion direction 30. Because front portion 28 of ink cartridge 25 is accommodated in the space of main body 36 of adapter 27, ink cartridge 25 moves toward opening 284 together with adapter 27, as shown in FIG. 13. Therefore, the user readily may remove ink cartridge 25 from case 280.

Because the information about the characteristic of ink cartridge 25 is indicated by adapter 27 based on the depth of bridge portion 189, a common ink cartridge 25 may be used independent of the characteristic of ink cartridge 25. When the ink in ink cartridge 25 is consumed, and a user wishes to use a new ink cartridges 25 having the same characteristic as the consumed ink cartridge 25, the user does not have to purchase a new adapter 27. The user may purchase a new ink cartridge 25, and the user may use the new ink cartridge 25 with adapter 27 already in the user's possession.

Because openings 177, 178 are formed in main body 36 of adapter 27, ink cartridge 25 may be mounted to case 280 after adapter 27 is mounted to case 280. Moreover, ink cartridge 25 moves toward opening 284 together with adapter 27 when a user holds grasp portion 170 and pulls adapter 27. Therefore, the user readily may remove ink cartridge 25 from case 280.

Figure 14:
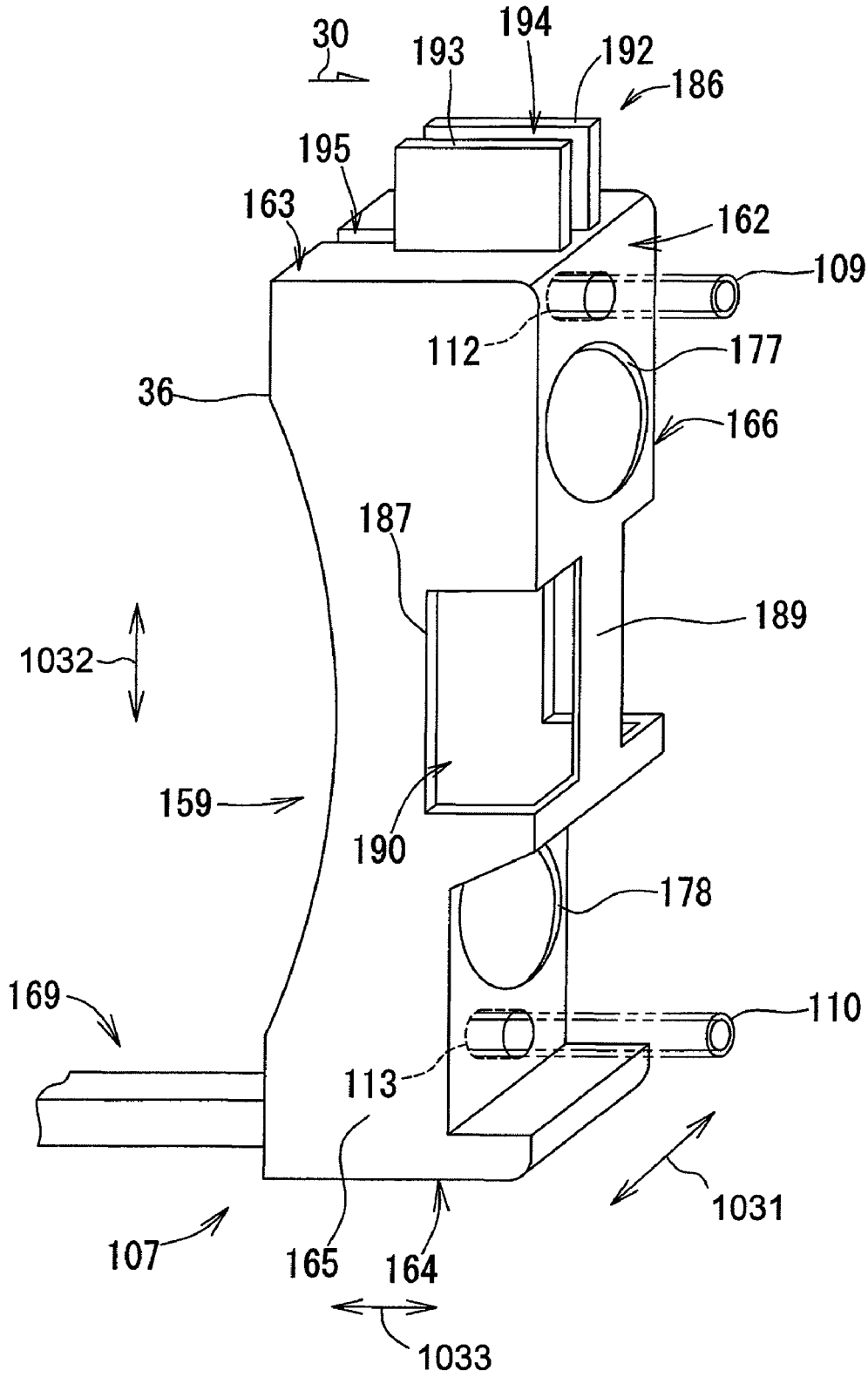
FIG. 14 is a perspective view of an adapter, according to another embodiment of the invention.
Figure 15:
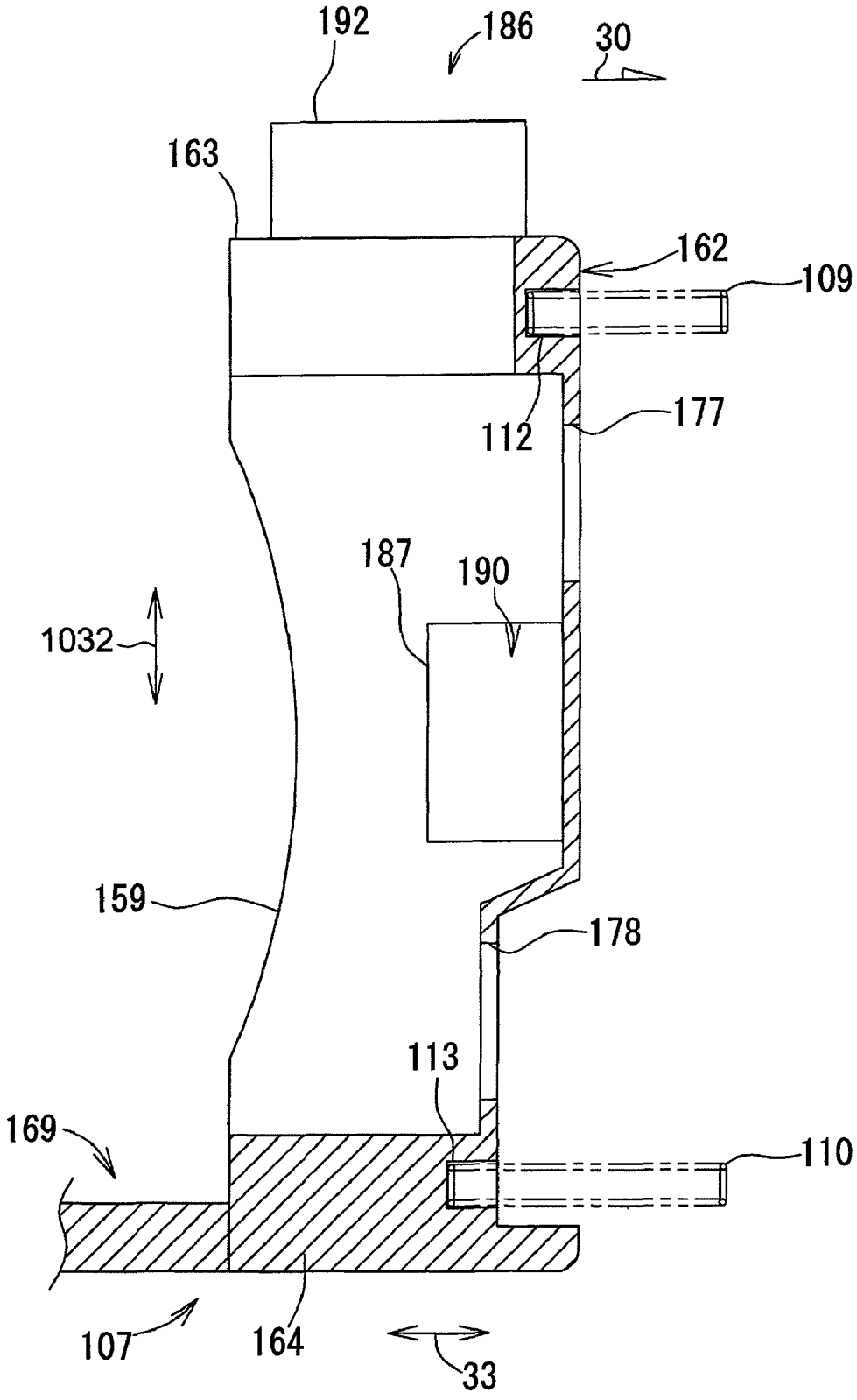
FIG. 15 is a side, cross-sectional view of the adapter of FIG. 14.

Referring to FIGS. 14 and 15, an adapter 107 according to another embodiment of the invention is depicted. Adapter 107 comprises coil springs 109, 110. Coil springs 109, 110 may be positioned at an outer surface of front wall 162 and may extend from front wall 162 away from front wall 162 in depth direction 1033. Front wall 162 has a spring receiving chamber 112 formed therein at a position between top wall 163 and opening 177. Spring receiving chamber 112 may be a cylindrical chamber extending from the outer surface of front wall 162 into front wall 162. Similarly, front wall 162 has a spring receiving chamber 113 formed therein at a position between bottom wall 164 and opening 178. Spring receiving chamber 113 may be a cylindrical chamber extending from the outer surface of front wall 162 into front wall 162. An end of coil spring 109 may be supported at the bottom of spring receiving chamber 112, and an end of coil spring 110 may be supported at the bottom of spring receiving chamber 113. Coil springs 105, 106 may be replaced with leaf springs or rubber springs.

Figure 16:
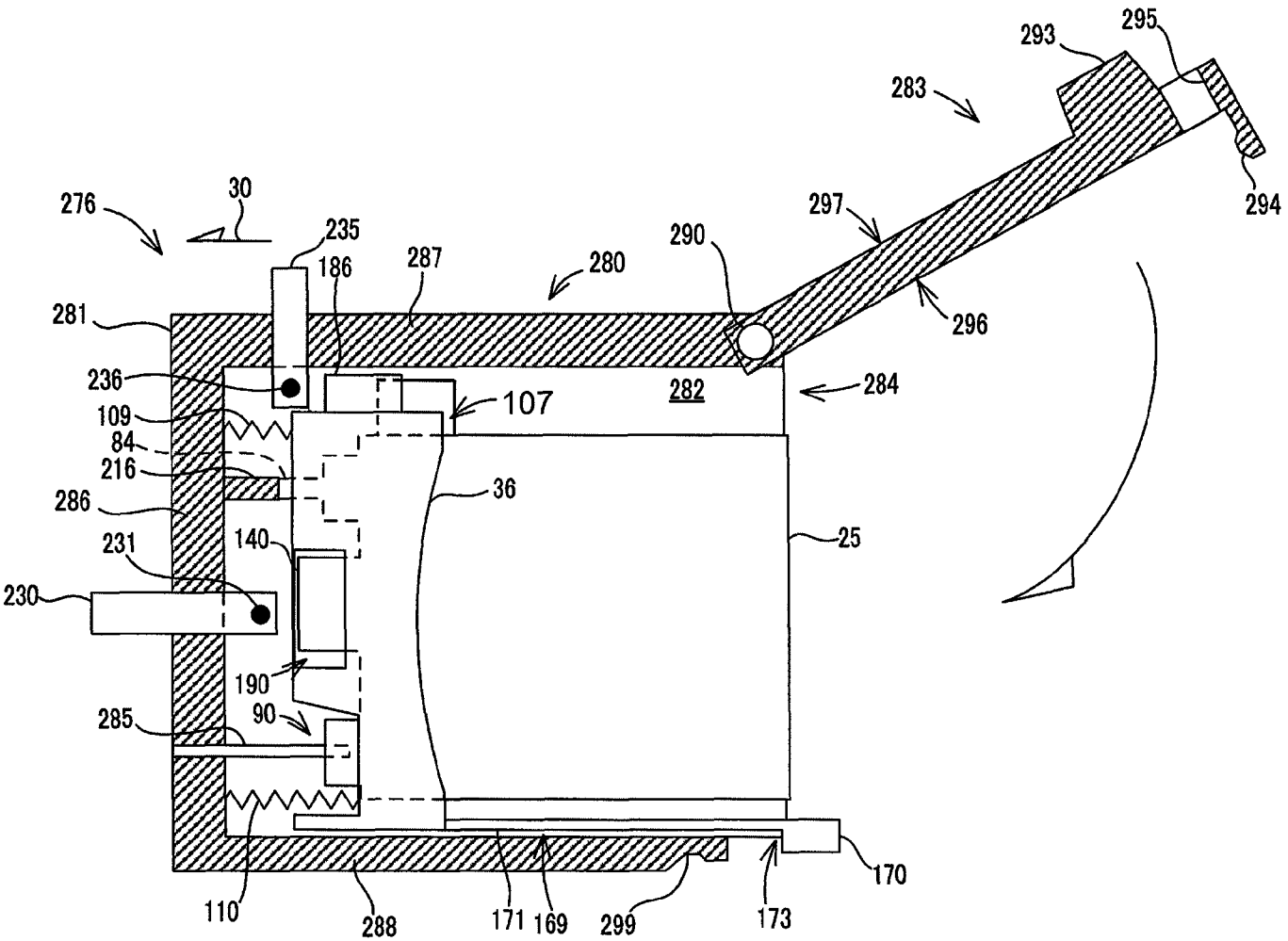
FIG. 16 is a side, partial, cross-sectional view of the cartridge mounting portion of FIG. 5, the adapter of FIG. 14, and the ink cartridge of FIGS. 2(A) and 2(B), in which the adapter and the ink cartridge are positioned in the cartridge mounting portion.
Figure 17:
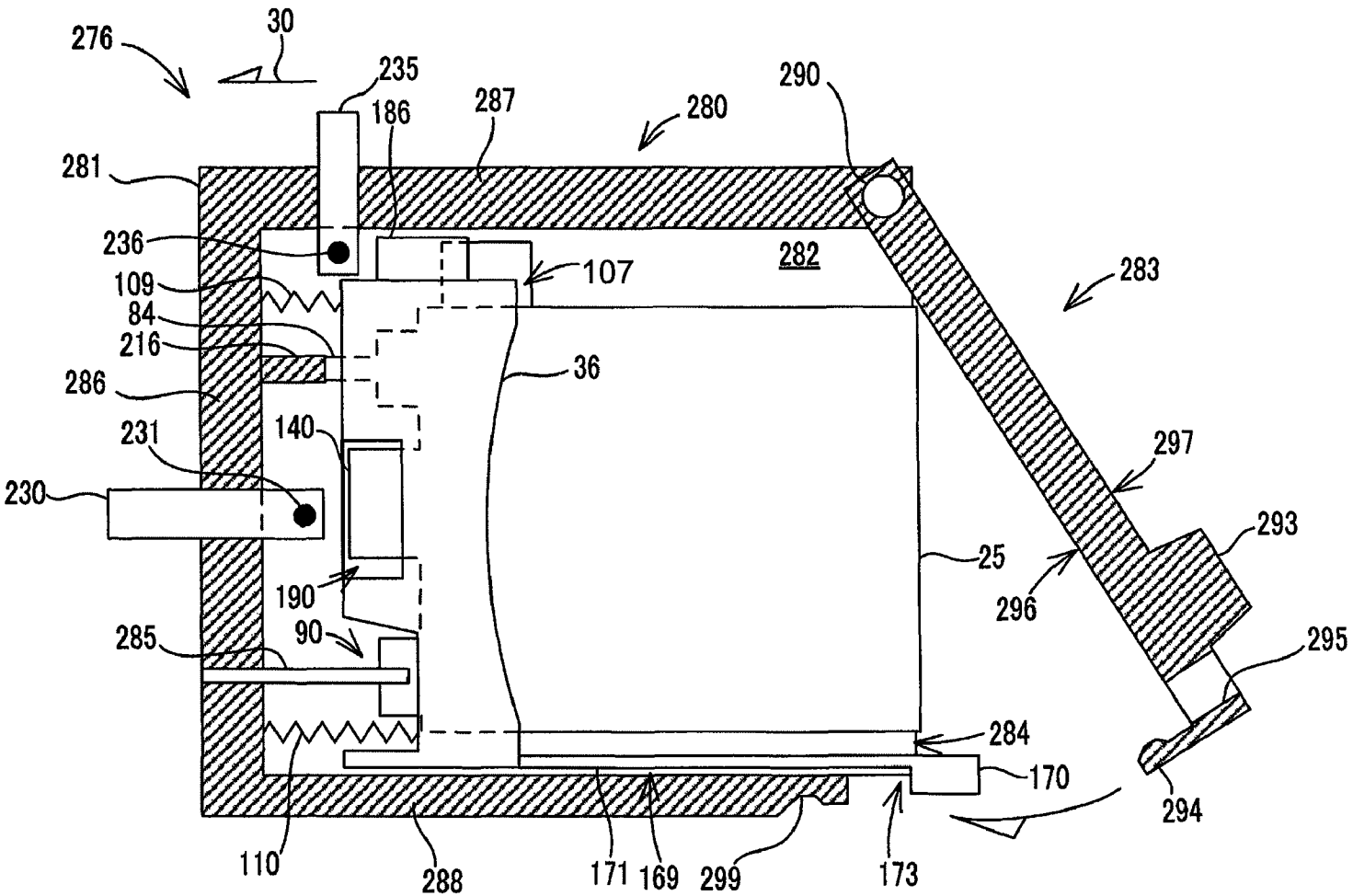
FIG. 17 is a side, partial, cross-sectional view of the cartridge mounting portion of FIG. 5, the adapter of FIG. 14, and the ink cartridge of FIGS. 2(A) and 2(B), in which the adapter and the ink cartridge are positioned in the cartridge mounting portion and the lock lever of the cartridge mounting portion is in contact with the ink cartridge.
Figure 18:
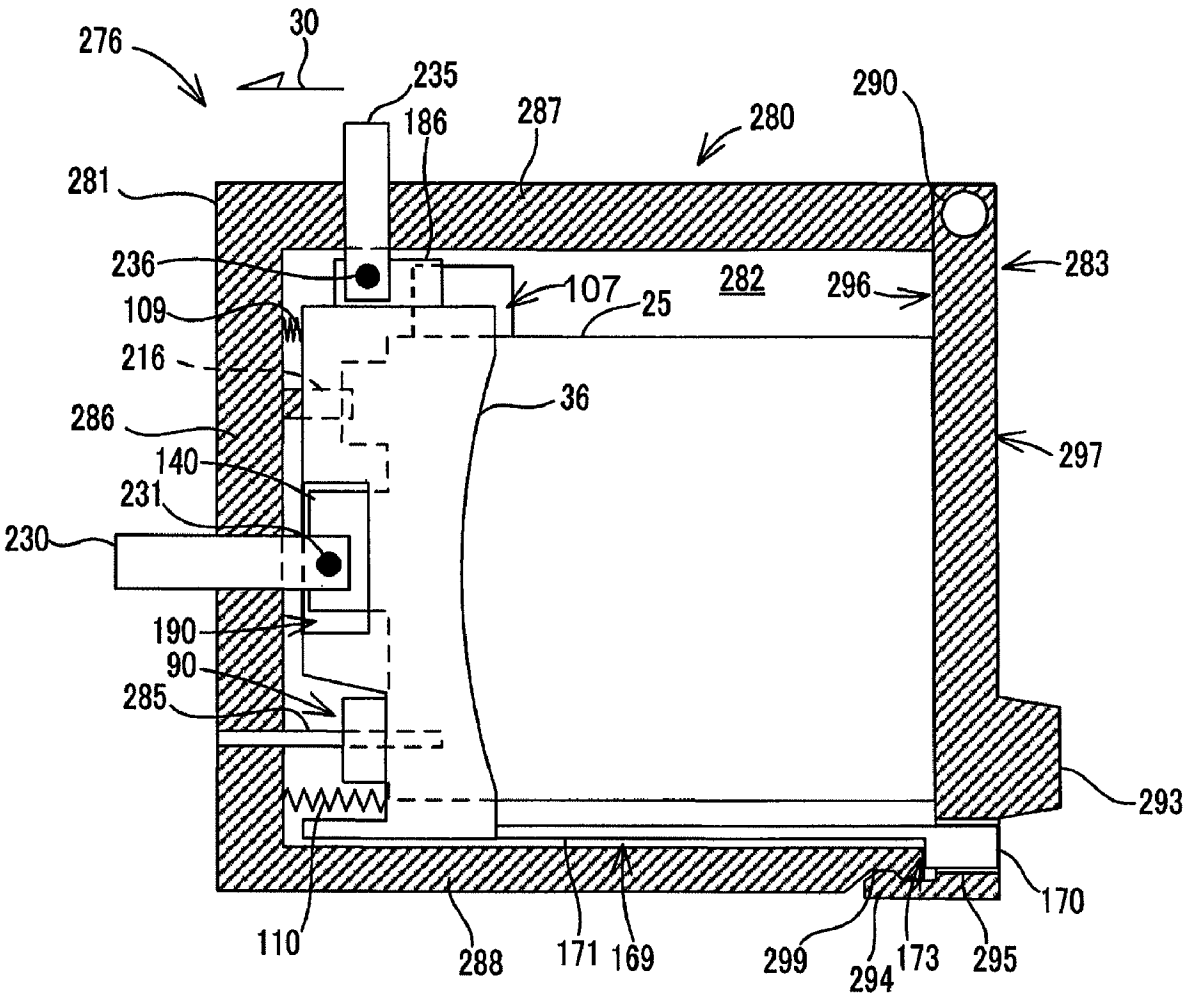
FIG. 18 is a side, partial, cross-sectional view of the cartridge mounting portion of FIG. 5, the adapter of FIG. 14, and the ink cartridge of FIGS. 2(A) and 2(B), in which the adapter and the ink cartridge are positioned in the cartridge mounting portion, the lock lever of the cartridge mounting portion is in contact with the ink cartridge, and the lock lever of the cartridge mounting portion is secured to the case of the cartridge mounting portion.

Referring to FIGS. 16-18, adapter 107 and ink cartridge 25 are inserted into accommodating chamber 282 and mounted to case 280 in the following manner.

When adapter 107 is inserted into accommodating chamber 282 from front wall 162-side via opening 284 toward end wall 286, front wall 162 faces end wall 286, and coil springs 109, 110 are positioned between front wall 162 and end wall 286 with ends of coils springs 109, 110 contacting end wall 286.

Subsequently, ink cartridge 25 is inserted into accommodating chamber 282, as shown in FIG. 16. Subsequently, lock lever 283 pivots toward opening 284, and inner surface 296 of lock lever 283 contacts rear outer face 42 of ink cartridge 25, as shown in FIG. 17. A user may push operation portion 293 to cause lock lever 283 to pivot. When lock lever 283 further pivots, lock lever 283 pushes ink cartridge 25 against biasing forces of coil springs 109, 110, respectively, while coil springs 109, 110 contract, respectively.

During the insertion of ink cartridge 25, bridge portion 189 enters optical path 231 of optical sensor 230, and detection portion 186 enters optical path 236 of optical sensor 235. Pushing portion 216 applies a force to rod 84, e.g., contacts and pushes rod 84, toward ink chamber 100 to cause the valve mechanism of air communication portion 80 to open. Ink chamber 100 is brought into fluid communication with the atmosphere via opening 81. Ink pipe 285 then enters ink supply portion 90, such that the valve mechanism of ink supply portion 90 is opened by ink pipe 285. Ink chamber 100 is brought into fluid communication with ink pipe 285, and ink is supplied from ink chamber 100 to recording head 272 via opening 91, ink pipe 285, and tube 278. When ink tank 25 is inserted to the end, detection portion 140 is exposed to the exterior of adapter 27 via openings 190, and detection portion 140 is positioned in optical path 231 of optical sensor 230.

When the second end of lock lever 283 moves toward groove 299 and claw 294 engages groove 299, lock lever 283 is closed and secured to main body 281, as shown in FIG. 18. After lock lever 283 is closed, ink cartridge 25 receives the biasing forces of coil springs 109, 110 toward opening 284, such that rear outer face 42 contact inner surface 296 of lock lever 283, and therefore, ink cartridge 25 is securely retained in case 280.

When ink cartridge 25 is removed from case 280, claw 294 disengages from groove 299, and lock lever 283 pivots upward. When this occurs, coil springs 109, 110 expand, respectively, and adapter 107 and ink cartridge 25 are pushed toward opening 284 by the biasing forces of coil springs 109, 110, and ink cartridge 25 is partially positioned outside case 280. Therefore, a user readily may remove adapter 107 and ink cartridge 25.

In the embodiments described above, adapter 27 or 107 is first inserted into accommodating chamber 282, and then ink cartridge 25 is inserted into accommodating chamber 282. Nevertheless, adapter 27 or 107 and ink cartridge 25 simultaneously may be inserted into accommodating chamber 282.

In another embodiment, detection portion 186 of adapter 27 or 107 may have a plurality of slits formed therein, and the plurality of slits may extend in height direction 1032. The number of the plurality of slits may depend on the characteristic of ink cartridge 25. The plurality of slits may allow light to pass therethrough. The controller may determine what kind of ink cartridge 25 is to be mounted by counting the number of the plurality of slits of detection portion 186 of adapter 27 or 107.

In another embodiment, an adapter may not comprise an operation member.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

The invention claimed is:

1. An ink cartridge assembly comprising:

an ink cartridge with a front side, a rear side, and at least one other side defining an ink chamber therein, wherein the ink chamber is configured to store ink therein; and an adapter configured to be coupled to the front side of the ink cartridge and inserted into a case of a recording apparatus in an insertion direction, wherein the adapter and the ink cartridge are separate members, and the adapter comprises:

a main body with a front face and at least one other face, wherein the front face of the main body corresponds to the front side of the ink cartridge when the front side of the ink cartridge is coupled to the adapter;

an operation portion extending from the main body in a particular direction, opposite the insertion direction, such that, when the adapter is coupled to the ink cartridge, the operation portion extends from the front side of the ink cartridge to the rear side of the ink cartridge along the at least one other side of the ink cartridge and further in the particular direction than the rear side of the ink cartridge; and a plate shaped portion positioned at the front face of the main body, the plate shaped portion being configured to block light emitted from a light emitting portion in the case of the recording apparatus when the adapter is inserted into the case of the recording apparatus so as to provide an indication of at least one characteristic of the ink that the ink chamber is configured to store.

2. The ink cartridge assembly of claim 1, wherein the main body has a main body opening formed therein, and the main body opening is configured to receive at least a portion of the ink cartridge.

3. The ink cartridge assembly of claim 1, further comprising at least one resilient member coupled to the adapter, wherein the at least one resilient member extends from the adapter in a further direction opposite the particular direction.

4. The ink cartridge assembly of claim 1, wherein the ink cartridge comprises an ink supply portion configured to dispense ink from an interior of the ink chamber to an exterior of the ink chamber, and the adapter has an ink supply opening formed therethrough, wherein when the adapter is coupled to the ink cartridge, the ink supply opening is configured to receive the ink supply portion therethrough.

5. The ink cartridge assembly of claim 4, wherein the ink cartridge comprises an air intake portion configured to draw air from the exterior of the ink chamber to the interior of the ink chamber, and the adapter has an air intake opening formed therethrough, wherein when the adapter is coupled to the ink cartridge, the air intake opening is aligned with the air intake portion in the particular direction.

6. The ink cartridge assembly of claim 1, wherein the at least one characteristic is at least one of an amount of ink that the ink chamber is configured to store and a color of ink that is stored in the ink chamber.

7. The ink cartridge assembly of claim 1, wherein the operation portion comprises a grasp portion opposite the main body that extends from the operation portion in a further direction such that, when the adapter is coupled to the ink cartridge, the grasp portion extends away from the at least one other outer surface of the ink cartridge at a location further than the rear side of the ink cartridge.

8. The ink cartridge assembly of claim 7, wherein the grasp portion is configured to detachably engage a lock lever that encloses the ink cartridge in the recording apparatus by covering the rear side of the ink cartridge.

9. The ink cartridge assembly of claim 8, wherein the adapter is configured to be removed from the recording apparatus when the operation portion is pulled in the particular direction.

10. The ink cartridge assembly of claim 1, wherein the operation portion is configured to extend further than the case of the recording apparatus when the adapter is disposed in the recording apparatus such that the operation portion can be grasped at an outside of the recording apparatus when the adapter is disposed therein.

11. The ink cartridge assembly of claim 10, wherein the ink cartridge is configured to be removed from the recording apparatus together with the adapter when the adapter is coupled to the ink cartridge and the operation portion is pulled in the particular direction.

12. The ink cartridge assembly of claim 1, wherein:

the plate shaped portion is configured to reflect light.

13. The ink cartridge assembly of claim 1, wherein:

the plate shaped portion is configured to prevent light from passing therethrough.

14. An ink cartridge assembly comprising:

an ink cartridge with a front side, a rear side, and at least one other side defining an ink chamber therein, wherein the ink chamber is configured to store ink therein; and an adapter configured to be coupled to the front side of the ink cartridge and inserted into a case of a recording apparatus, wherein the adapter and the ink cartridge are separate members, and the adapter comprises:

a main body with a front face and at least one other face, wherein the front face of the main body corresponds to the front side of the ink cartridge when the front side of the ink cartridge is coupled to the adapter;

an operation portion extending front the main body in a particular direction such that, when the adapter is coupled to the ink cartridge, the operation portion extends from the front side of the ink cartridge to the rear side of the ink cartridge along the at least one other side of the ink cartridge and further in the particular direction than the rear side of the ink cartridge; and a plate shaped portion positioned at the front face of the main body, the plate shaped portion being configured to block light emitted from a light emitting portion in the case of the recording apparatus when the adapter is inserted into the case of the recording apparatus so as to provide an indication of at least one characteristic of the ink that the ink chamber is configured to store, wherein the operation portion is configured to receive the ink cartridge thereon.

15. The ink cartridge assembly of claim 14, wherein the operation portion is configured to support the ink cartridge thereon.

16. An ink cartridge assembly comprising:

an ink cartridge with a front side, a rear side, and at least one other side defining an ink chamber therein, wherein the ink chamber is configured to store ink therein; and an adapter configured to be coupled to the front side of the ink cartridge and inserted into a case of a recording apparatus, wherein the adapter and the ink cartridge are separate members, and the adapter comprises:

a main body with a front face and at least one other face, wherein the front face of the main body corresponds to the front side of the ink cartridge when the front side of the ink cartridge is coupled to the adapter;

an operation portion extending front the main body in a particular direction such that, when the adapter is coupled to the ink cartridge, the operation portion extends from the front side of the ink cartridge to the rear side of the ink cartridge along the at least one other side of the ink cartridge and further in the particular direction than the rear side of the ink cartridge; and a plate shaped portion positioned at the front face of the main body, the plate shaped portion being configured to block light emitted from a light emitting portion in the case of the recording apparatus when the adapter is inserted into the case of the recording apparatus so as to provide an indication of at least one characteristic of the ink that the ink chamber is configured to store, wherein the plate shaped portion extends across an opening in the front face of the main body.

17. The ink cartridge assembly of claim 16, wherein:

the plate shaped portion has a depth in the particular direction; and the depth of the plate shaped portion is what provides an indication of the at least one characteristic of the ink that the ink chamber is configured to store.

* * * * *